US007658510B2

(12) United States Patent
Russell

(10) Patent No.: US 7,658,510 B2
(45) Date of Patent: Feb. 9, 2010

(54) SYSTEM AND METHOD FOR POWER CONTROL IN A LED LUMINAIRE

(75) Inventor: Ronald James Russell, Toronto (CA)

(73) Assignee: Remco Solid State Lighting Inc., Etobicoke, ON ( * ) Notice: Subject to any disclaimer, the term of this patent is extended or adjusted under 35 U.S.C. 154(b) by 91 days.

(21) Appl. No.: 11/676,430

(22) Filed: Feb. 19, 2007

(65) Prior Publication Data

US 2007/0195527 A1 Aug. 23, 2007

Related U.S. Application Data

(63) Continuation-in-part of application No. PCT/CA2005/001255, filed on Aug. 18, 2005.

(60) Provisional application No. 60/602,335, filed on Aug. 18, 2004.

(30) Foreign Application Priority Data

Aug. 18, 2004 (CA) ..... 2,478,001
May 11, 2005 (CA) ..... 2,507,081

(51) Int. Cl.
*F21V 21/00* (2006.01)

(52) U.S. Cl. ..... 362/249.02; 362/294; 362/800; 315/291; 315/294

(58) Field of Classification Search ..... 362/246, 362/294, 545, 555, 612, 800, 249.02; 315/291, 315/294; 323/265
See application file for complete search history.

(56) References Cited

U.S. PATENT DOCUMENTS 6,600,274 B1 * 7/2003 Hughes ..... 315/291
6,933,707 B2 * 8/2005 Allen ..... 315/294

* cited by examiner

*Primary Examiner*—Stephen F Husar

(57) ABSTRACT

The present invention is directed to an LED lighting source comprising a housing adapted for coupling to an AC power source; a rectifier circuit for converting the AC power to a DC supply; a power control circuit disposed in the housing and electrically connected to the DC supply; a string of LED's electrically connected between a control node of the power control circuit and the DC supply, the LEDs in the string being connected in series and being of a number selected to produce a voltage difference across the power control circuit sufficient to power active components of said power control circuit when powered from the DC supply and the power control circuit for limiting a forward current through the string to a nominal forward current of a single LED.

21 Claims, 22 Drawing Sheets

SYSTEM AND METHOD FOR POWER CONTROL IN A LED LUMINAIRE

CROSS REFERENCE TO RELATED APPLICATIONS

This is a continuation-in-part of International Patent application Serial No. PCT/CA2005/001255, filed Aug. 18, 2005, which is a continuation-in-part of U.S. Provisional application Ser. No. 60/602,335 filed Aug. 18, 2004.

FIELD OF THE INVENTION

The present invention relates to a LED (light emitting diode) luminaire. In particular, the present invention relates to a system and method for power regulation of an LED array in high lumen output residential and commercial applications.

BACKGROUND OF THE INVENTION

It is recognised that LED light sources are theoretically more efficient than incandescent light bulbs and solutions have been proposed to construct LED luminaires as for example taught in U.S. Pat. No. 6,609,804. A luminaire usually refers to a complete lighting unit which contains one or more electric lighting sources and associated reflectors, refractors, housing, and such support for those items as necessary with the parts designed to distribute the light, to position and protect the lighting sources and to connect the lighting sources to a power supply. LED's are usually operated with a nominal 20 mA forward direct current and 3.5V forward voltage. The voltage drop across a LED is substantially independent of the current through the diode. Typical LED luminaires are usually constructed from an array of discrete LED's which operate together to provide a desired lumen value and are incorporated within a light fixture having a low voltage DC converter within the fixture to convert the AC mains supply to a low voltage DC supply for powering the LED array. The AC to DC converters are bulky, making it a challenge to fabricate a LED lighting fixture to replace, for example, an existing Edison type incandescent light bulb fixture.

Furthermore, the optical performance of LED's are affected by a rise in temperature This thermal problem has reduced the feasibility of LEDs as viable lighting sources and has limited the wide spread adoption of LEDs as commercial and residential lighting sources.

Thus, there still remains a need for an LED light source that can easily replace standard residential and commercial light fixtures but which uses less bulky power control systems and runs cooler.

SUMMARY OF THE INVENTION

The present invention in one aspect is directed to an LED luminaire comprising an interface for connecting the luminaire to a source of electrical power, an LED array producing a light of a suitable intensity and color for the task for which the luminaire is to be used, a power control section for supplying and controlling power to the LED array and a light diffuser for diffusing the light from the LED array to produce suitable light for the task for which the luminaire is to be used.

In accordance with another aspect of the invention there is provided a method for controlling power provided an LED array, comprising the steps of:

selecting a predetermined number of LED's in one or more arrays of series connected LED's, said array having a first terminal for coupling directly to a terminal of an electrical power source;

coupling a power control circuit in series between said power source and a second terminal of said array so as to limit a forward current through said LED's in said array to a nominal forward current of said LEDs and said number of LED's being selected so as to produce a voltage difference across said power control circuit sufficient to power the active components of said power control circuit.

In accordance with a further aspect there is provided an LED lighting source comprising:

a housing adapted for coupling to an AC power source;

a rectifier circuit for converting said AC power to a DC supply;

a power control circuit disposed in said housing and electrically connected to said DC supply;

a string of LED's electrically connected between a control node of said power control circuit and said DC supply, the LEDs in the string being connected in series and being of a number selected to produce a voltage difference across said power control circuit sufficient to power the active components of said power control circuit when powered from said DC supply and said power control circuit for limiting a forward current through said string to a nominal forward current of a single LED.

In accordance with a further aspect there is provided a high voltage LED light source comprising:

an LED array including a series coupled string of LED's;

an ac to dc converter for converting said Ac supply to a DC supply;

a power control section for controlling power in the LED array, said series coupled string of LED's electrically connected between a control node of said power control section and said DC power supply, the LEDs in the string being of a number selected to produce a voltage difference across said power control circuit sufficient to power the active components of said power control circuit when powered from said DC supply and said power control circuit for limiting a forward current through said string to a nominal forward current of a single LED such that the power control section utilizes the dynamic resistance of the LED array as an active component of the control section.

In accordance with a further aspect there is provided an LED light fixture comprising:

(a) an interface for connecting the fixture to a source of electrical power to provide power to an LED array producing a light of a suitable intensity and color for the task for which the fixture is to be used, the LED array including one or more strings of serially coupled LED's;

(b) a light diffuser for diffusing the light from the LED array to produce suitable light for the task for which the fixture is to be used; and (c) a power control section for controlling power in the LED array, at least one said string of LED's electrically connected between a control node of said power control section and a DC power supply, the LEDs in the string being of a number selected to produce a voltage difference across said power control circuit sufficient to power the active components of said power control circuit when powered from said DC supply and said power control circuit for limiting a forward current through said string to a nominal forward current of a single LED such that the power control section utilizes the dynamic resistance of the LED array as an active component of the control section.

In accordance with a further embodiment there is provided a mechanical structure for interconnection of said LEDs in said array and for providing thermal conduction of heat from the LED array.

BRIEF DESCRIPTION OF THE DRAWINGS

Preferred embodiments of the present invention are shown in the drawings, wherein.

DETAILED DESCRIPTION OP THE PREFERRED EMBODIMENTS

Figure 1:
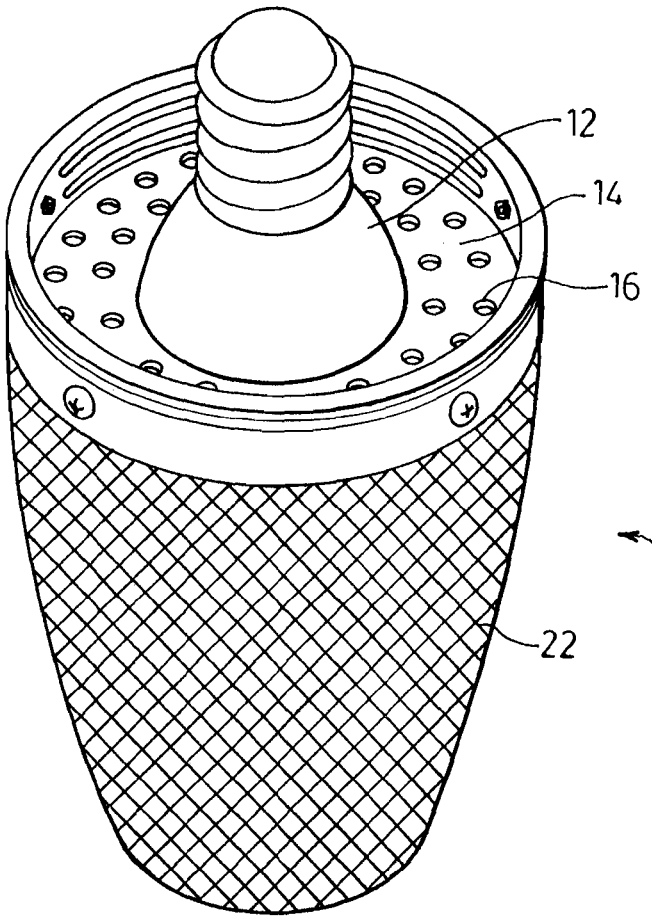
FIG. 1 is a perspective view of a first embodiment of an LED luminaire according to the present invention.
Figure 2:
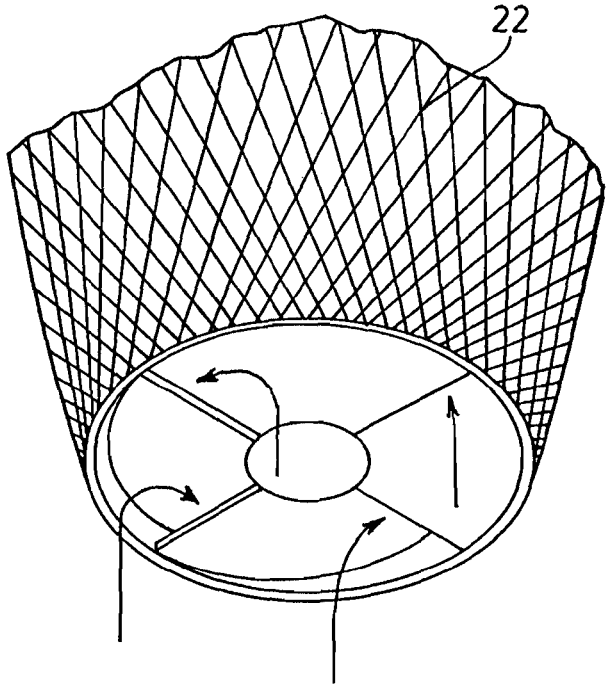
FIG. 2 is a perspective view of the bottom of the luminaire of FIG. 1.

The LED luminaire of the present invention includes an interface for mechanically attaching to a fixture, a power control section, an electro-thermal core and an LED array and optics. The interface connects the LED luminaire to a light fixture in turn connected to an electrical power source. Preferably, in one embodiment the interface allows the LED luminaire to be a luminaire to be used in existing incandescent fixtures as described below. In other embodiments, the LED luminaire replaces traditional fluorescent lighting bulbs. The power control section is responsible for controlling power to the LED array and ensures optimum light output under a wide range of ambient temperatures, as well as maximizing the life of the individual LEDs by controlling generation of heat. The electrothermal core makes possible the interconnection of a very high-density array of LEDs. The LED array optics provides the desired luminous spectrum and distribution of the light from the LEDs. The structure and operation of preferred embodiments of the LED luminaire of the present invention will now be described.

A first embodiment of an LED luminaire of the present invention for use as a replacement for residential incandescent light bulbs is illustrated in FIGS. 1 to 5 and generally indicated by the numeral 10. The LED luminaire 10 is provided with a screw base interface 12, which fits into the standard screw base fixtures. The screw base 12 is affixed to a thermal cap 14 for enclosing the LEDs and containing openings 16 to allow for air flow through the luminaire 10 as will be described later.

The screw base 12 also houses the power control electronics used for powering the LED array. The screw base 12 is a flanged form with a cavity space 18 that accommodates the power control circuitry 20. An acrylic frosted diffused lens 22 covers the LED array 24 and is attached to the thermal cap 14.

The electrothermal core section 24 makes possible the interconnection of a very high-density array of LEDs 26. The core 24 provides electrical interconnection, thermal collection and physical support for the LEDs 26. The heat generated in the array is dispersed by a controlled convection airflow through the thermal cap 14.

Figure 3:
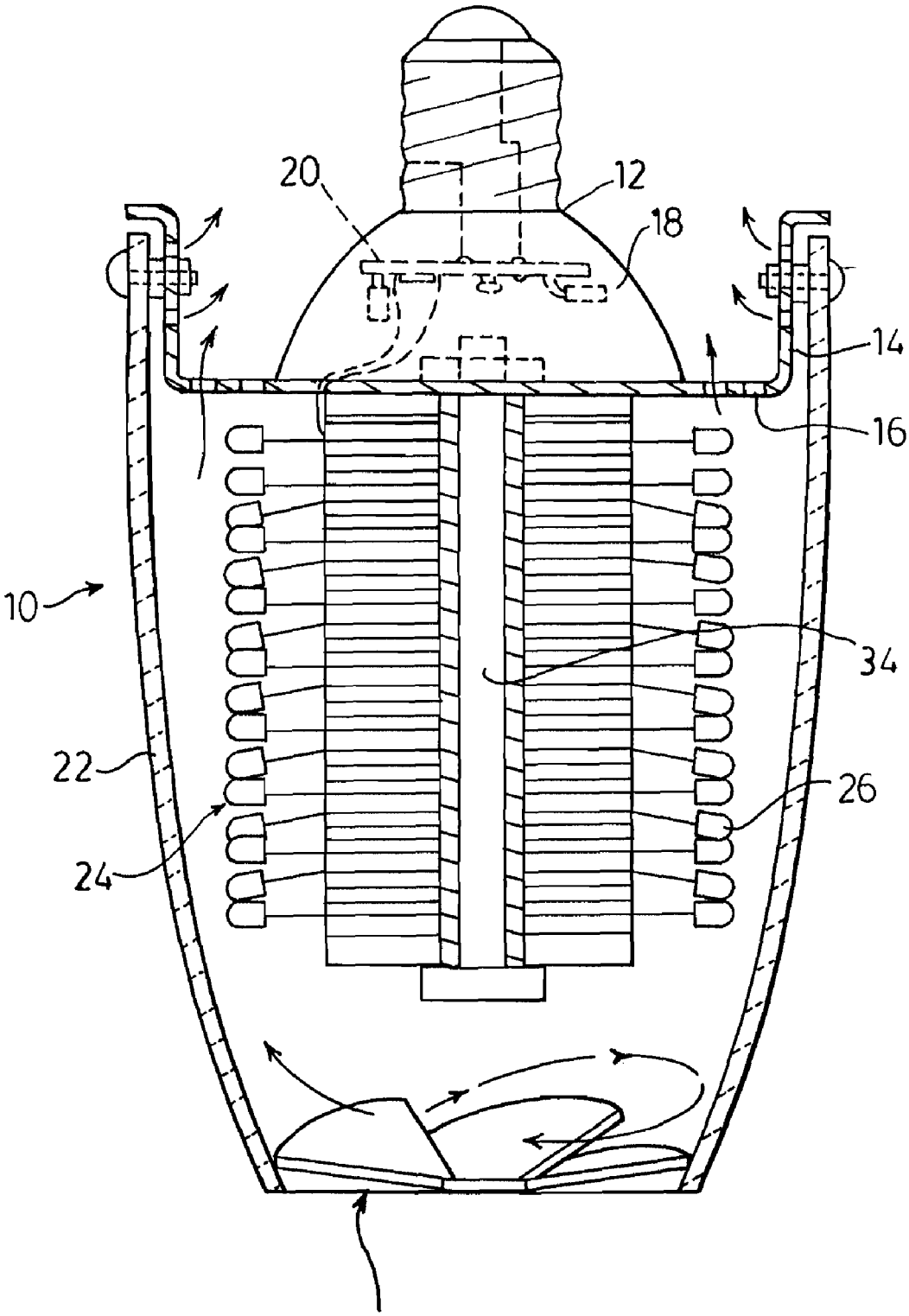
FIG. 3 is a side elevation view in cross-section of, the LED luminaire of FIG. 1.
Figure 4:
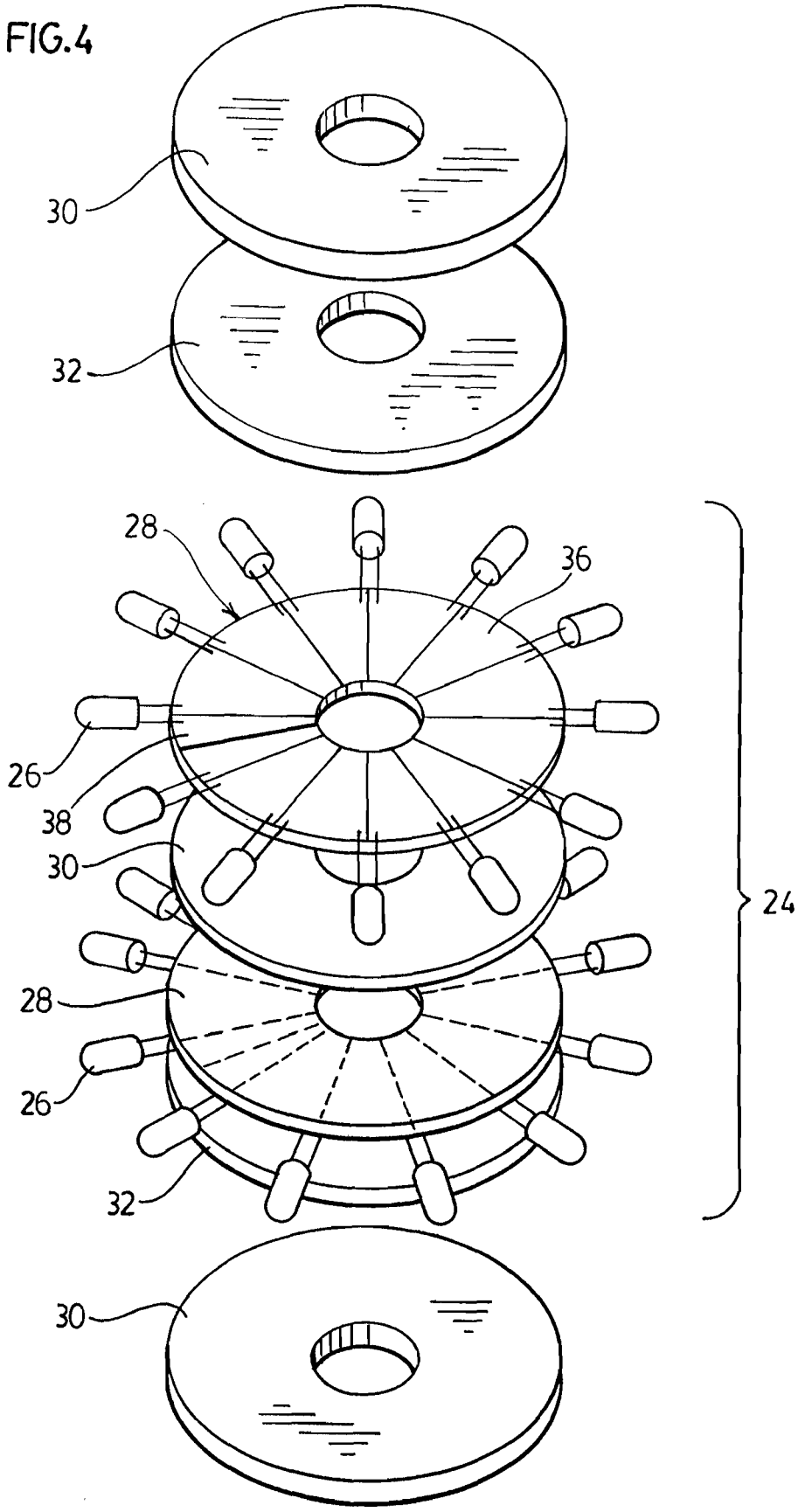
FIG. 4 is an exploded perspective view of an electro-thermal core of the LED luminaire of FIG. 1.
Figure 5:
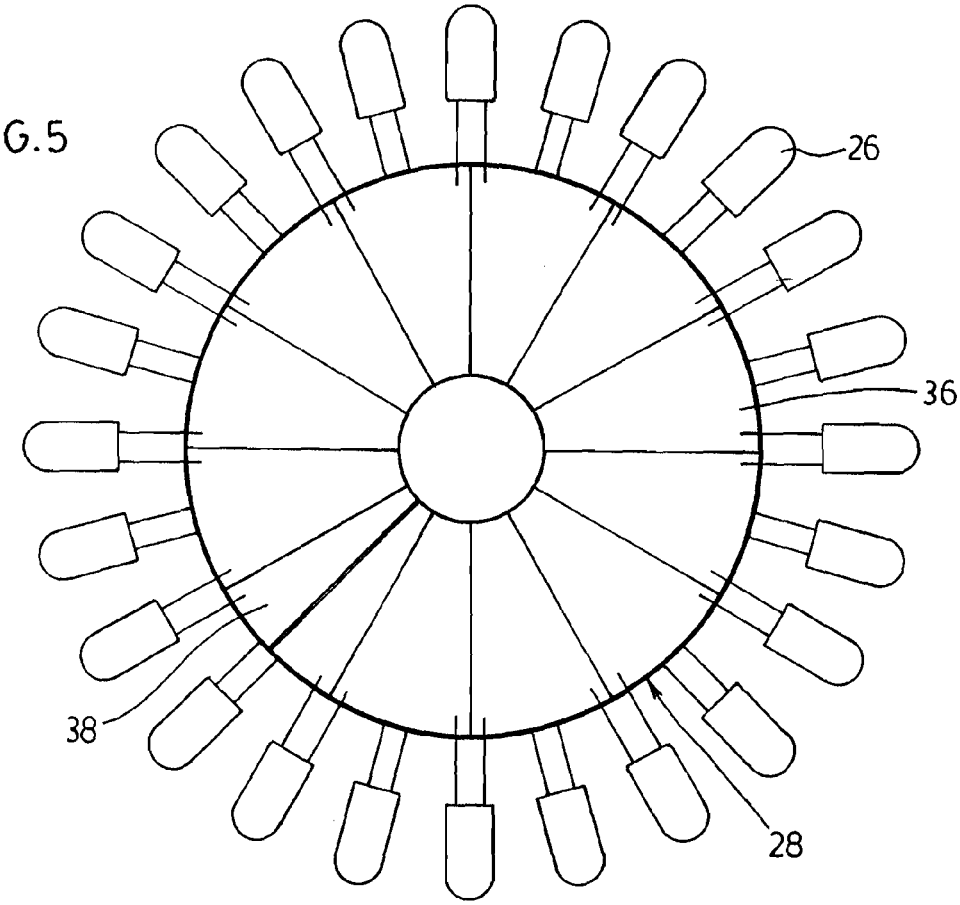
FIG. 5 is a top plan view of the electro-thermal core of the LED luminaire of FIG. 1.

As illustrated in FIGS. 3 to 5, in the first embodiment, the electro thermal core 24 is a segmented structure that consists of a series of disks stacked so as to form a core. There are three disk types: circuit disks 28, metal disks 30, and insulator disks 32. All disks types are designed to have a high thermal conductance. The disks are secured by means of a retaining rod 34 that is threaded through the center of the disk stack.

The surfaces of the disks are machined and mated so as to reduce thermal resistances between them for maximum heat transfer. The circuit disks 28 have twelve 30-degree segments 36; one of the segments 38 is split and serves as a circuit interconnection point. This allows each circuit disk 28 to have twelve LEDs 26 connected in series. Four circuit disks 28 are connected in series to provide an LED cluster of forty eight LED's. To increase light output, a number of the LED clusters are connected in parallel. Typically two to six such clusters are connected in parallel. To improve light diffusion, the LED clusters are interleaved and not stacked one above the other. Metal disks 30 and insulating disks 32 are placed appropriately in the stack and thermal compound is used on all mating surfaces. The stack is threaded together by an insulated retaining rod 34 and attached to the thermal cap 14. The cap 14 serves several functions and is one of the key design elements.

The constructed core is then thermally and mechanically secured to the thermal cap 14 thereby completing the thermal circuit.

The luminous spectrum and distribution of the light from the LED array is a function of the LED type and optical path. Preferably two types of 5 mm LEDs are utilized to produce a white light with a CRI of 85+.

Figure 6:
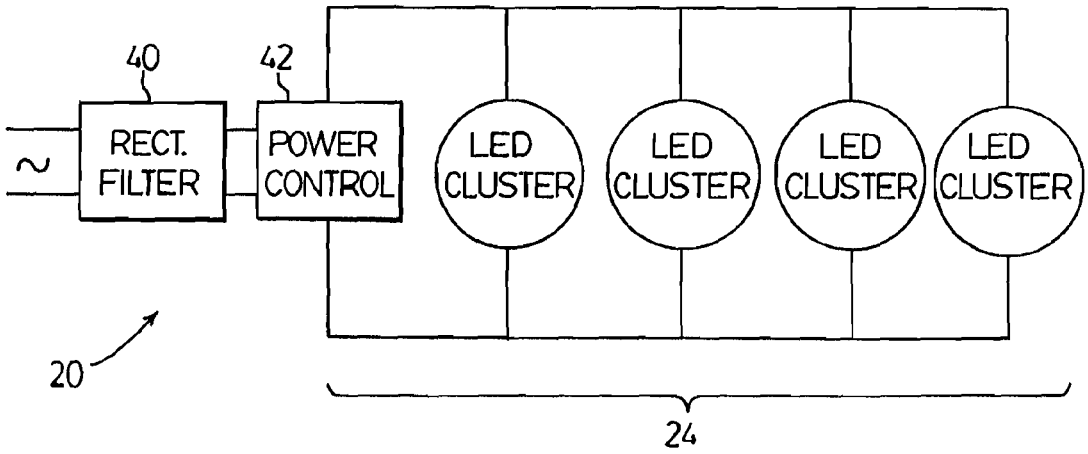
FIG. 6 is a block diagram of an electrical circuit diagram of the LED luminaire of FIG. 1.

The core is covered and contained by a frosted diffuser, which has two primary functions of light distribution and airflow control. The light from the individual LEDs is collated and scattered using a frosted diffuser lenses thereby evenly distributing the light in all directions. The cavity of the frosted diffuser lenses, when attached to the thermal cap, creates a venturi. Cool air enters the inlet and may pass over an optional impeller, which creates a consistent uniform turbulence, which in turn, increases the rate of airflow through the venturi, thereby reducing the core temperature. Hot air is then ported through the venturi outlet completing the airflow path. The powercontrol section 20 is responsible for supplying and controlling power to the LED array 24 and ensures optimum light output under a wide range of ambient temperatures, as well as maximizing the life of the LEDs 26. As illustrated in FIG. 6, the powercontrol section 20 provides rectification and filtering through a linear DC supply having linear current regulation and optical choke.

Conventional LED power controllers are based on various switching circuits that are placed in series with the LED array. The switching rate and duration controls the effective power, and therefore, the heat generated. Some drawbacks to these prior arrangements include RFIEMI-line contamination causing interference with other electronic devices, circuit complexity with high part count, additional heat generated by controller circuit which reduces efficiency and circuit life, and causes strobe effects.

The power control of the present invention eliminates some of the above disadvantages.

It has been found that a prototype replacement for an incandescent bulb as illustrated in FIGS. 1 to 6 containing; four LED clusters or 192 LEDs produces the equivalent light output of a 60 watt incandescent bulb while consuming about 20 watts or ⅓ the electrical power of an 60 Watt incandescent bulb resulting in about a 66% electrical power savings. The operating temperature of the bulb was 125 deg. F. which is 35 deg. F lower than a 60 watt bulb. The expected life expectancy of the LED luminaire is 20+ Years in continuous use.

In the first preferred embodiment, as described above, the LED luminaire 10 is designed to replace an existing 60 Watt incandescent light bulb and by changing the interface, the luminaire may be used in other types of fixtures as well as for other applications.

For example, the LED luminaire of the present invention as described above, may also be used to replace other types of light sources, such as fluorescent lights. A lay in panel, similar to existing fluorescent fixtures may be provided with a number of receptacles for a screw base. Generally anywhere from 4 to 8 such receptacles are provided depending upon the desired light output. The receptacles are wired to a junction box for connection to the electrical wires from the supply.

Figure 7:
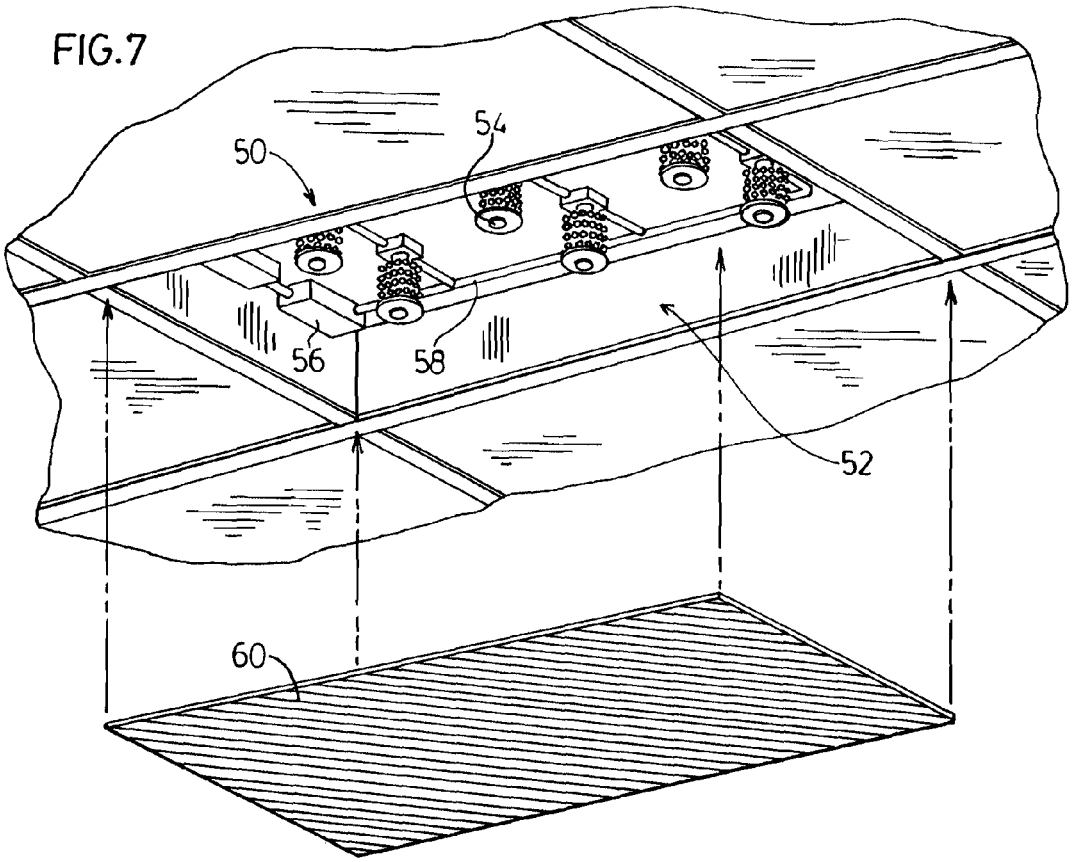
FIG. 7 is a perspective view of an embodiment of the LED luminaire of FIG. 1 in a ceiling panel fixture.

Alternatively, as illustrated in FIG. 7, a replacement lay in panel 50 may be provided to replace existing fluorescent lay in panels. The panel 50 is provided with a recess 52 containing the LED luminaires 54. The interface is a junction box 56 which allows direct connection to the wiring in a conventional manner. The powercontrol circuitry may be contained within the junction box 56 and the output wires 58 of the powercontrol section lead to connectors for the LED arrays. A frosted diffuser panel 60 is provided to evenly distributing the light in all directions.

Figure 8:
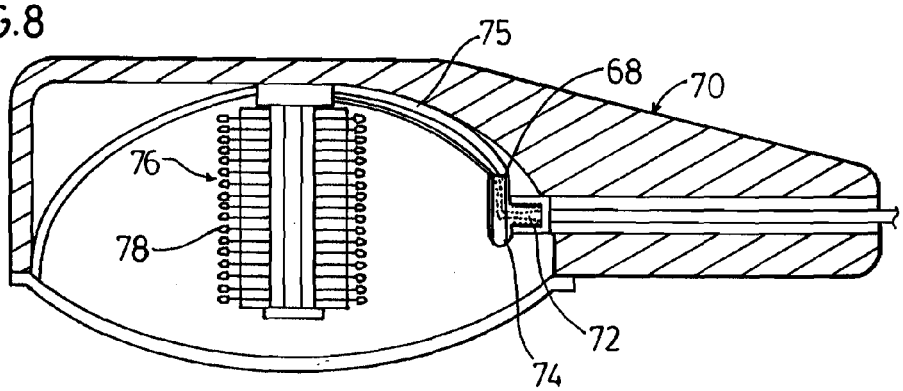
FIG. 8 is a side elevation view partly in cross section of a second embodiment of an LED luminaire of the present invention in a street lamp fixture.
Figure 9:
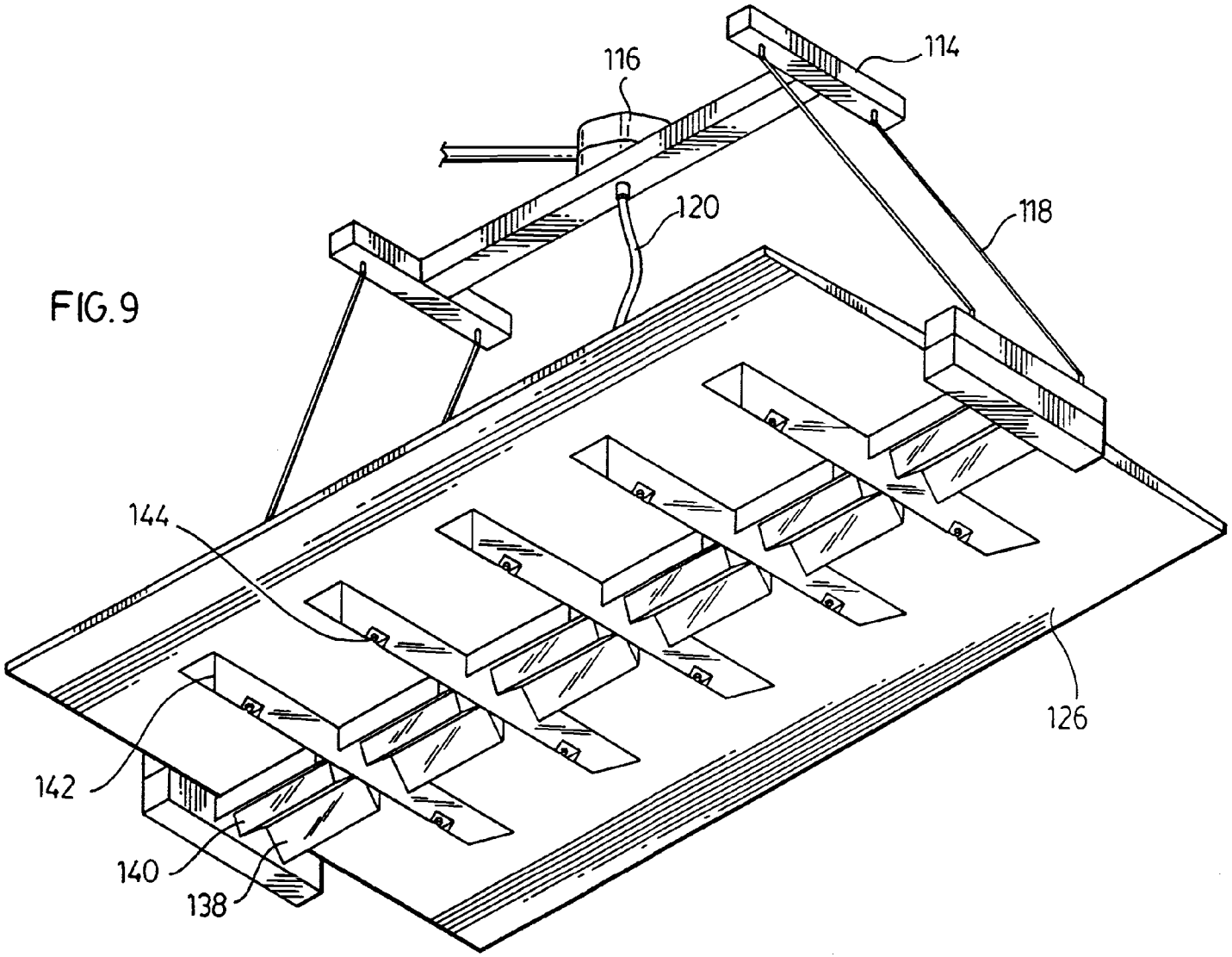
FIG. 9 is a perspective view of a third embodiment of an LED luminaire according to the present invention.
Figure 10:
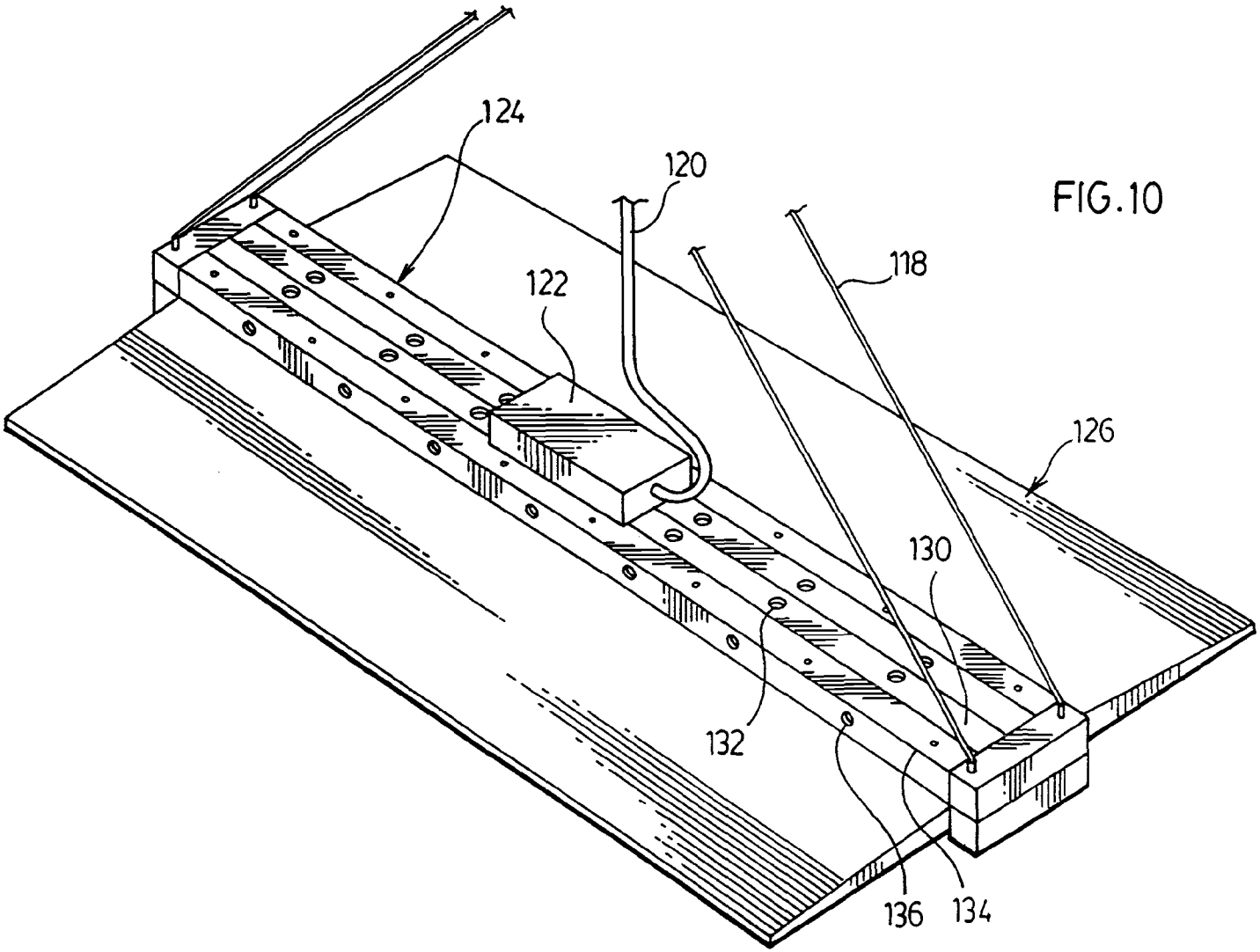
FIG. 10 is a perspective view of the top of the LED luminaire of FIG. 9.
Figure 11:
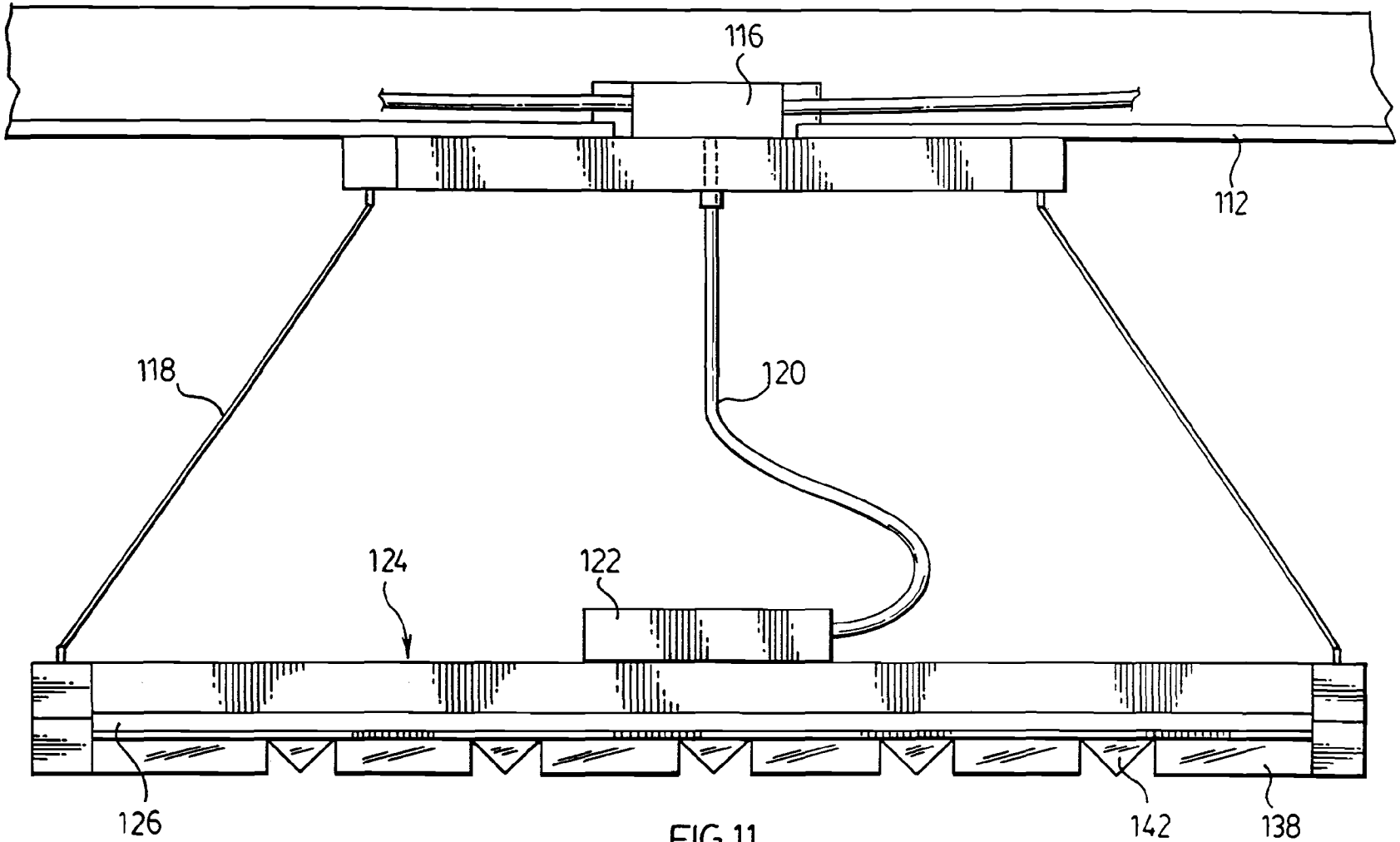
FIG. 11 is a side elevation view of the luminaire of FIG. 9.

A second embodiment of an LED luminaire 68 of the present invention is illustrated in FIG. 8 for use as a street light in a typical cobra head street light head 70. The luminaire 68 is provided with a screw base interface 72 which allows it to be connected to the light head 70. Similar to the first embodiment, the powercontrol section 74 is contained within the screw base 72. The electrothermal core and LED array are mounted in the top of the cobra head and connected to the powercontrol section 74 in the screw base 72 by wires 75, The electrothermal core 76 contains the high density array of LEDs 78 arranged similar to the first embodiment. The LEDs 78 are arranged in 8 clusters of 48 LEDs in each cluster. The core is constructed similar to the first embodiment with circuit disks, metal disks and insulator disks. As the cobra head 70 is provided with a diffuser cover 80, a separate diffuser for the LED luminaire 68 is not required.

A third embodiment of the LED luminaire of the present invention for use in replacement of fluorescent light fixtures as illustrated in FIGS. 9 to 14 generally indicated by the numeral 110. The LED luminaire 110 illustrated in the figures is adapted to be suspended from a ceiling 112. A mounting bracket 114 such as that illustrated in the figures is attached to the ceiling 112 over the electrical outlet box 116. The luminaire 110 is suspended from the bracket 114 through the use of suitable suspension guy wires 118 and is connected to the electrical box 116 by wire 120. Wire 120 is in turn connected to a control box 122 which contains the power control circuitry for supplying and controlling the power to the LED array assembly 124, the details of which will be described further below. The light from the LED array 124 passes through a diffuser system 126 to provide for even and uniform light output from the luminaire. The details of the light components of this embodiment are illustrated in detail in FIGS. 12 through 14. The embodiment illustrated utilizes a chip based LED array 128. These chips are provided with about 42 LEDs per each chip and the light illustrated in the figures utilizes 14 such chips per side. The LED light array utilizes two parallel rows of LEDs 128 each independently fed and controlled by the control section. The LED chips 128 are mounted on a thermal core heat sink. 130 which allows for the heat generated by the LEDs 128 to be dissipated into the atmosphere. The version of the heat sink 130 utilized in the embodiment illustrated is a metal tube 130 to which the LED chips 128 have been attached. The hollow metal tube 130 is provided with openings 132 along the top and sides thereof to allow for air flow through the tube 130 to aid in heat dissipation. A further pair of tubes 134 outboard of the tubes 130 to which the LED chips 128 are mounted are provided to allow for attachment of the other optical components. These tubes 134 are also provided with holes 136 which align with the holes 132 in the tubes 130 of the heat sink to allow for the proper air flow as is illustrated in detail in FIG. 14.

In the fixture 110 illustrated in FIGS. 9 to 14, the light from the LED 128 is directed downwardly into a prism 138, which reflects the light into the diffuser system 126. In the embodiment illustrated, the diffuser system 126 is a wave-guide, which provides for diffusion of the light from the LED 128 along the entire surface of the wave guide. The prisms 138 are held in place by a mounting tube 140 and the entire assembly is connected by cross bridges 142, In the embodiment illustrated, the cross bridges 142 are further lengths of prism to provide for an aesthetically pleasing appearance to the luminaire. The whole assembly is bolted together using bolts 144.

Figure 12:
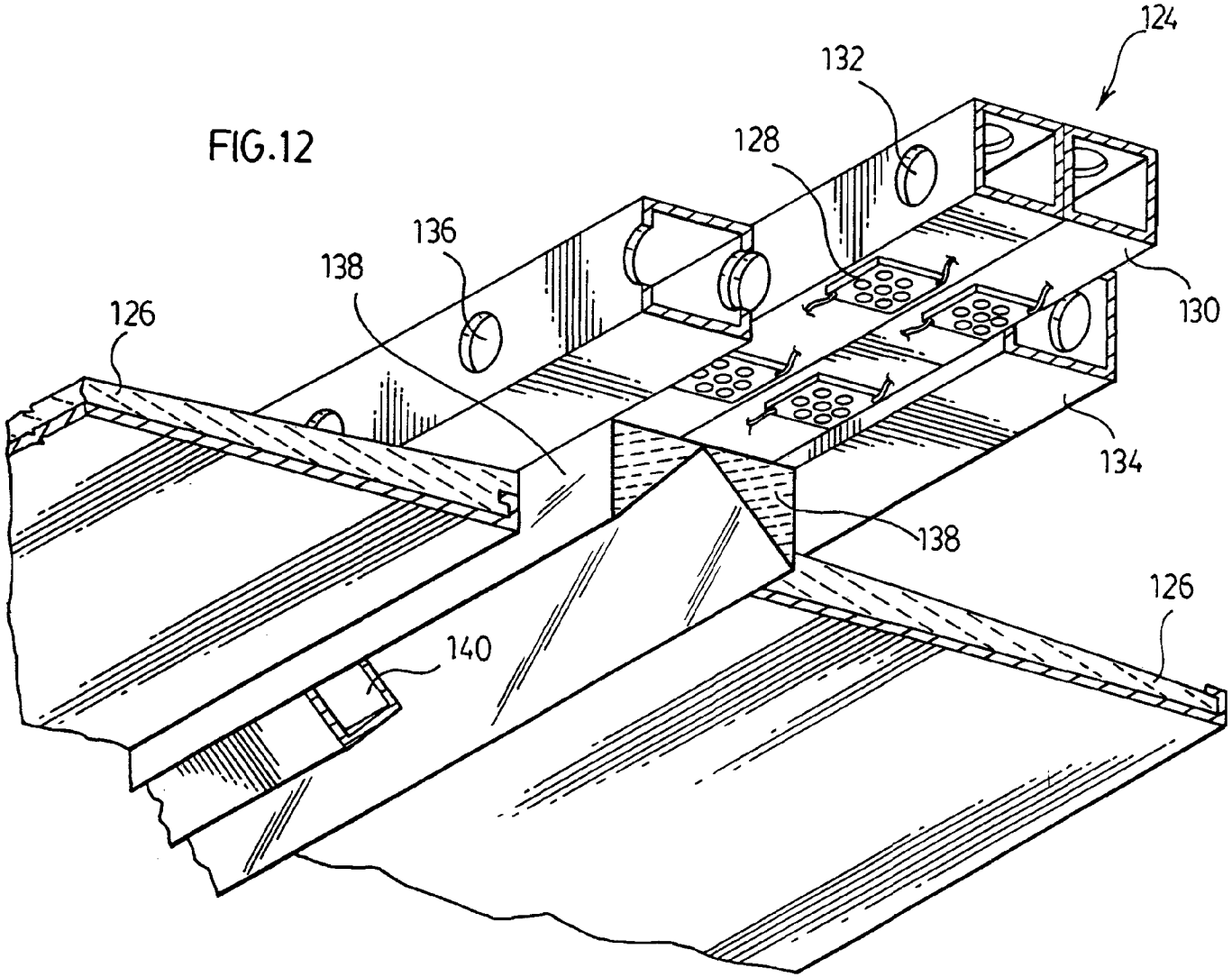
FIG. 12 is a perspective view in section of the LED luminaire of FIG. 9.
Figure 13:
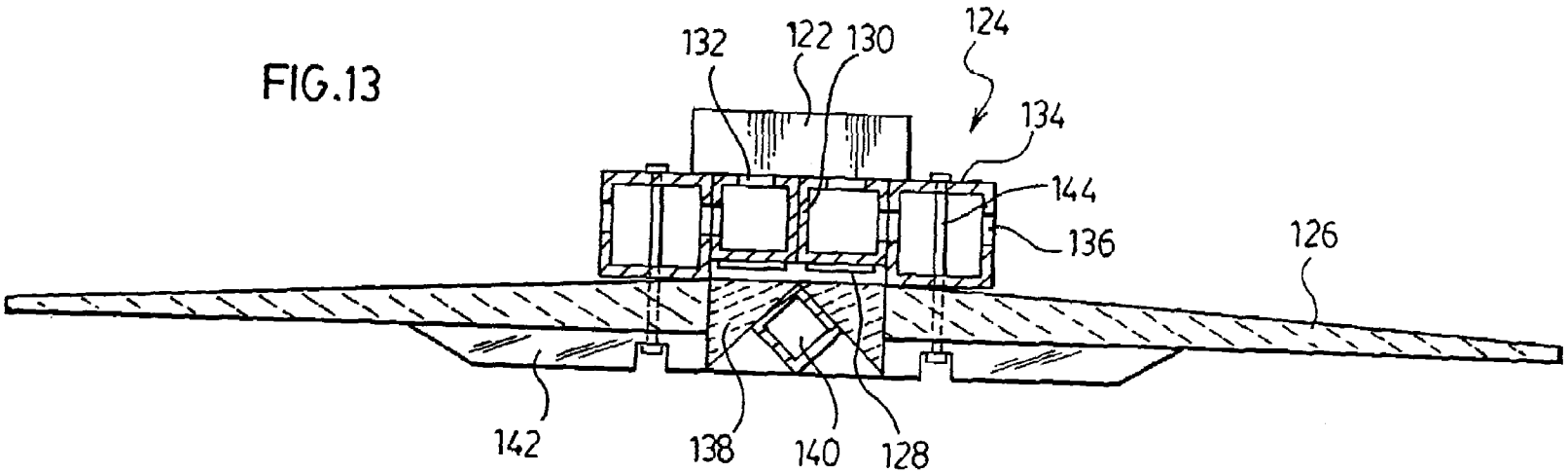
FIG. 13 is a cross-section of the LED luminaire of FIG. 9.
Figure 14:
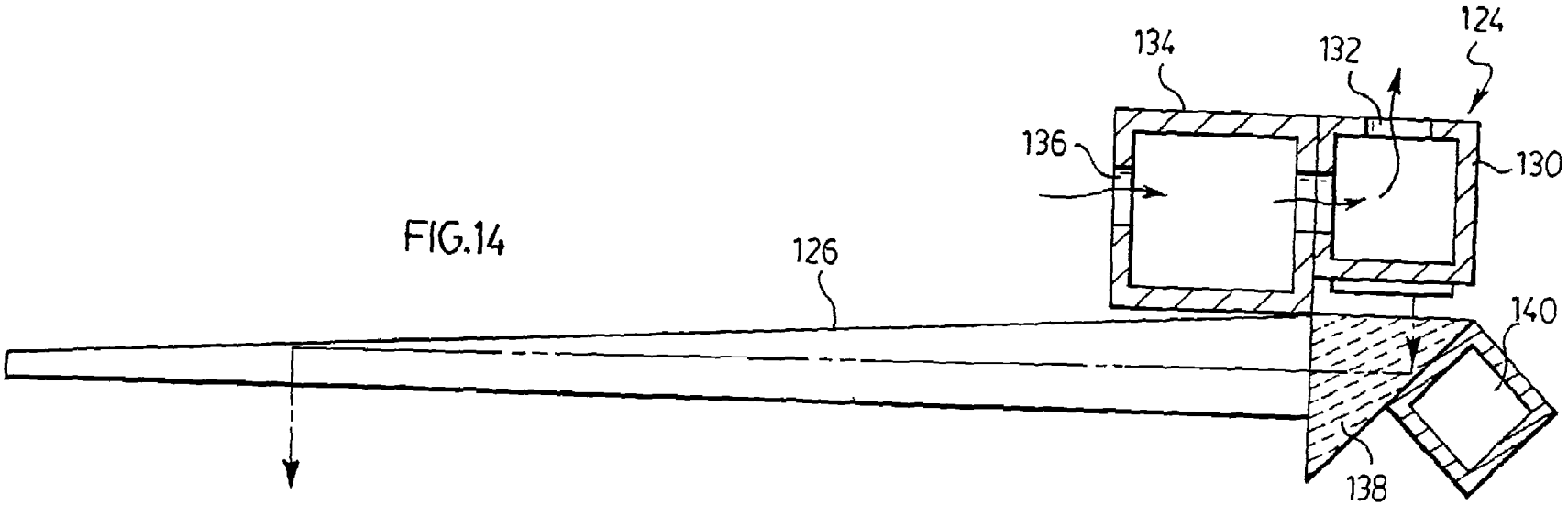
FIG. 14 is a cross-section of one half of the LED luminaire of FIG. 9 showing the light path and path for the cooling air.

This embodiment as shown in FIG. 12 utilizes a two stage optic system 15 comprised of prisms that are placed directly in the light path of the LED chips. Since the purpose of this invention is to illuminate a room with evenly distributed light and the light output of the LED chips are a point source, a secondary optic system must be incorporated into the fixture that can collect and diffuse the light.

To provide light distribution, this embodiment utilizes a fundamental optic principal called total internal reflection (TIR). Right angle can be used to change the direction of an incident light beam through a phenomenon called TIR. Other characteristics of prisms include frustration and multiple images, which, by altering the angles of the prisms, spacing between them, and surface treatments of the prisms, can also be used to control the direction and diffusion of a light source.

In the embodiment of FIG. 12, two prisms 138 and 126 are used to form the optic system required, one prism is used to guide the light, and the other is used to guide and diffuse the light. Together the two prisms form an optic system that distributes and diffuses the point source light from the LED's.

Figure 15:
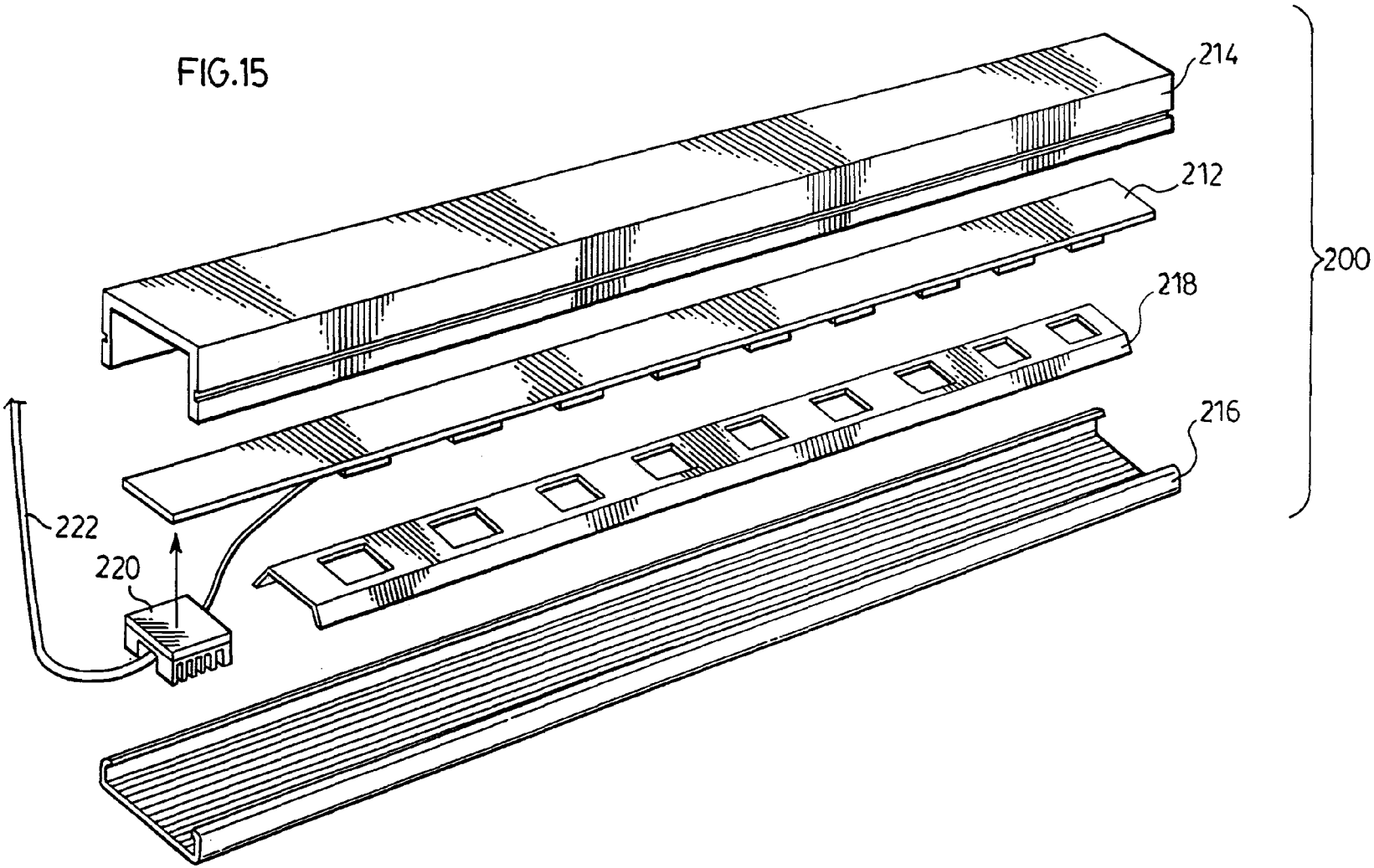
FIG. 15 is an exploded perspective view of a fourth embodiment of an LED luminaire of the present invention.

A fourth embodiment of a LED luminaire of the present invention is illustrated in FIG. 15 generally indicated by the numeral 200. This luminaire is provided with an LED array 212 mounted within a housing 214. A diffuser 216 is provided to attach to the housing 214 and hold the components within the housing 214. In order to space the LED array 212 from the diffuser 216, a spacer strip 218 is provided which allows for airflow for cooling of the LED array 212. The LED's are powered by a powercontrol component 220 connected to an electrical source by wire 222. The embodiment of the invention illustrated in FIG. 15 is particularly useful for strip lighting or replacing fixtures having a single fluorescent tube.

This embodiment of the LED luminaire of the present invention is of particular use for grow bulbs for use in greenhouses and other such applications. These grow bulbs provide for photosynthetic active radiation (PAR) which typically is light in the wave length range 400 to 525 nm, 610 to 720 nm. These wave lengths can be duplicated in the luminaire of the present invention by utilizing suitable red and blue LED emitting light at the desired wave lengths.

Figure 16:
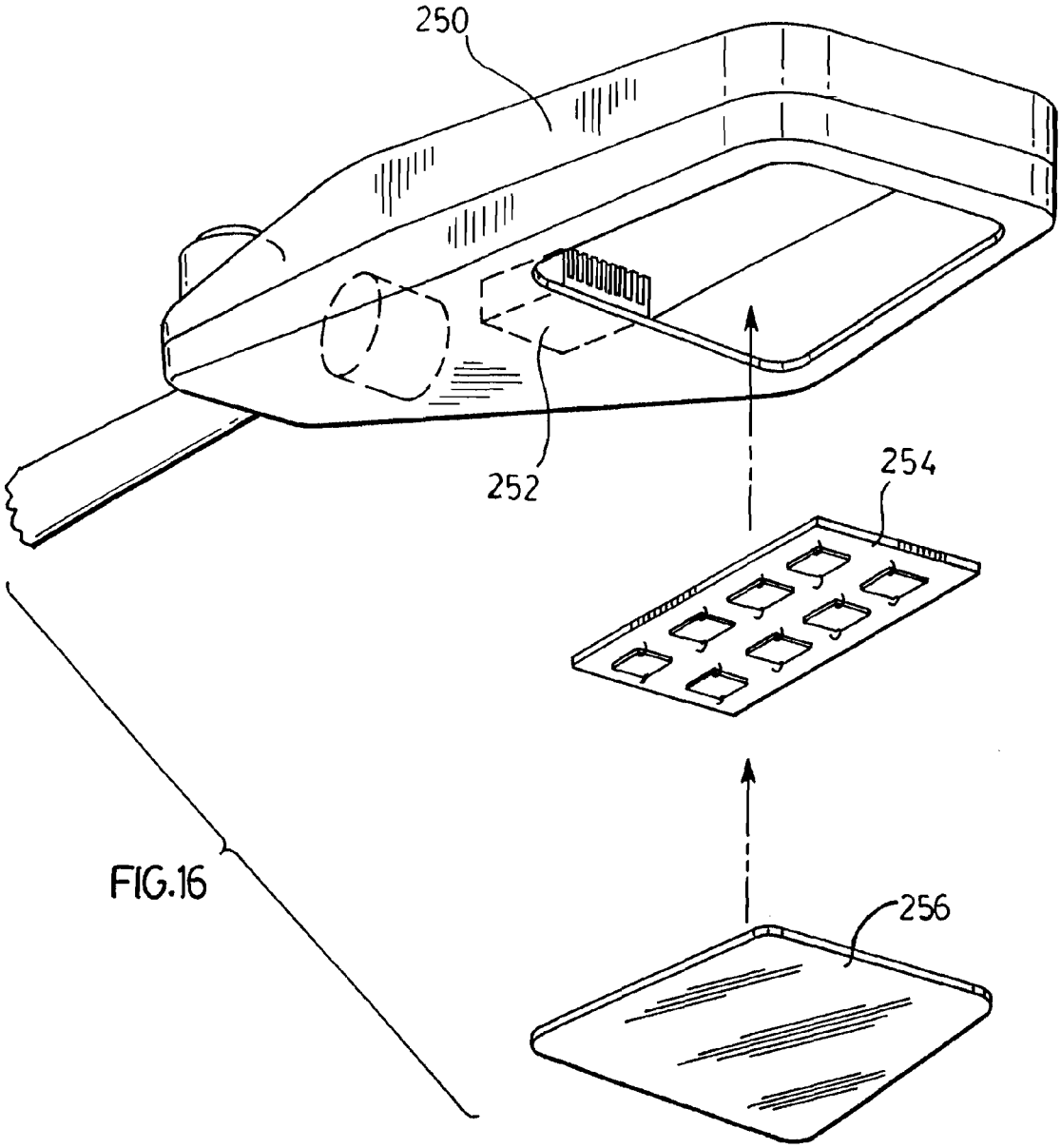
FIG. 16 is an exploded perspective view of a fifth embodiment of a luminaire of the present invention.

A fifth embodiment of an LED luminaire of the present invention is illustrated in FIG. 16. This embodiment is for use as a streetlight in a typical cobra head street light head 250. The cobra head is provided with control circuitry 252 and an LED light array 254 for mounting within the cobra head. A diffuser panel 256 is provided to diffuse the light generated by the LED array.

Figure 17:
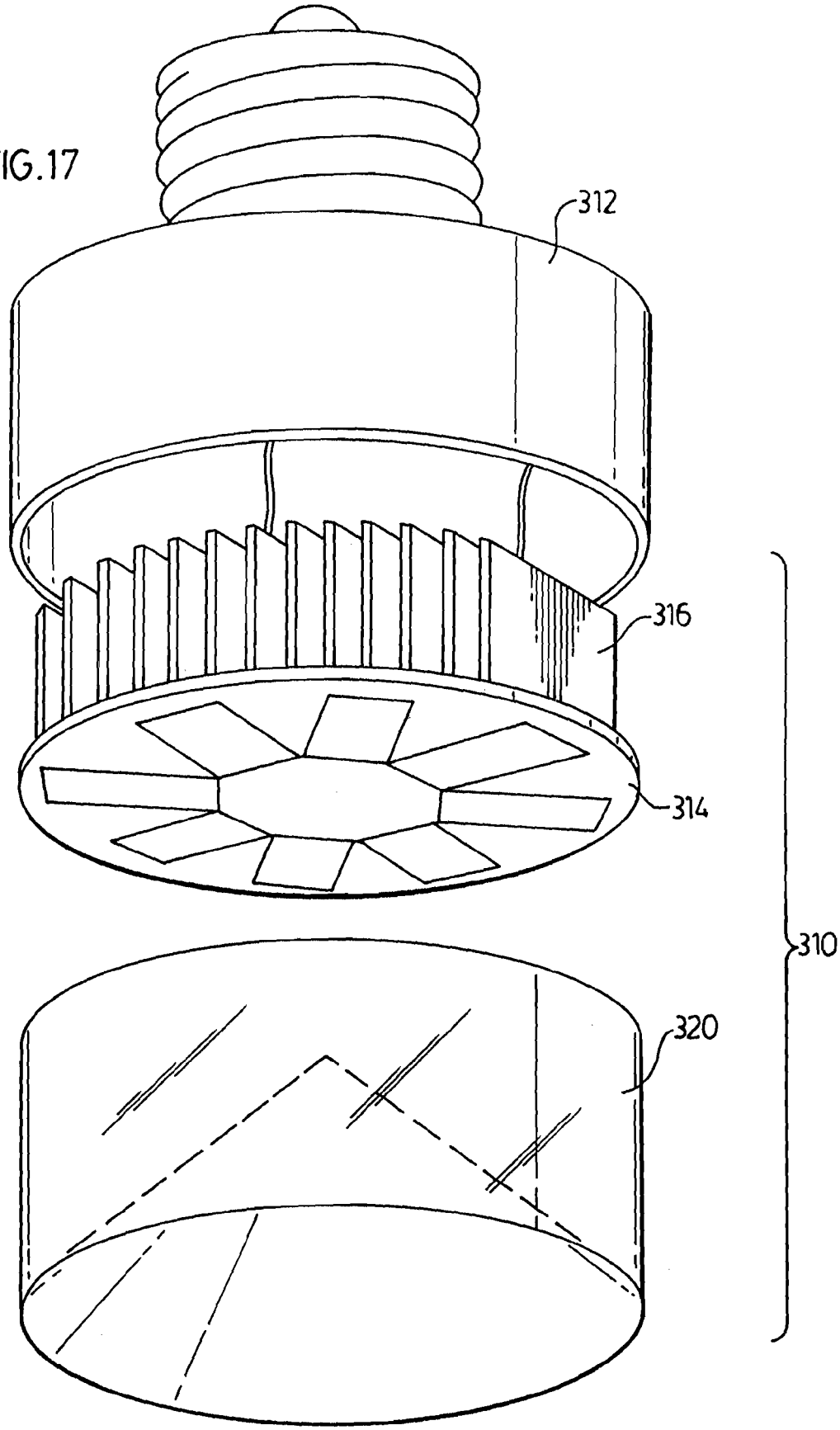
FIG. 17 is an exploded perspective view of a sixth embodiment of a luminaire of the present invention.
Figure 18:
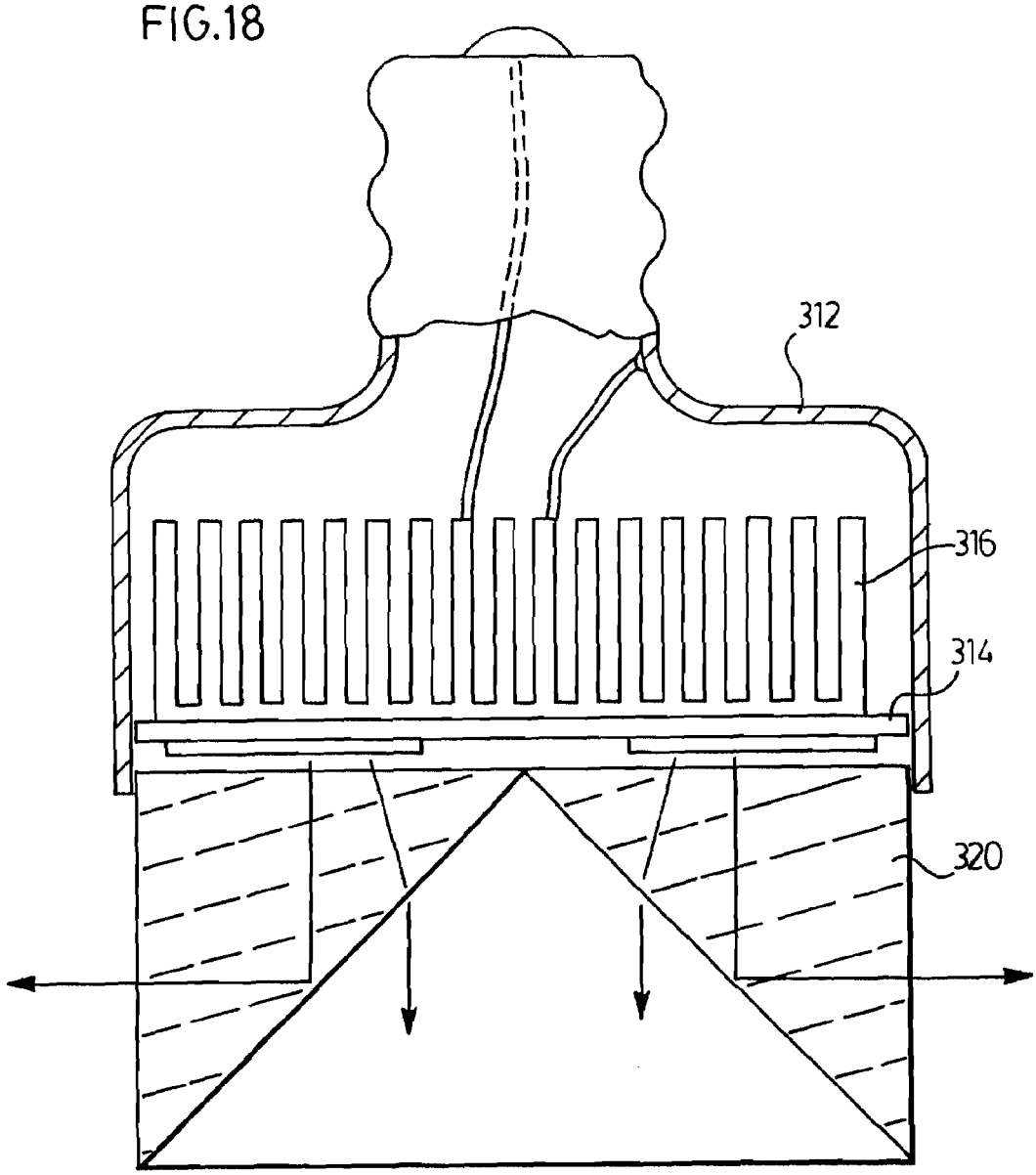
FIG. 18 is a side elevation view in cross section of the luminaire of FIG. 16.

A sixth embodiment of a luminaire according to the present invention for use in replacing incandescent light bulbs is illustrated in FIGS. 17 and 18 generally indicated by the numeral 310. The LED luminaire 310 is provided with a screw base interface 312 that fits into the standard screw fixtures. The luminaire 310 is provided with a LED light array 314 and heat sink 316 connected to an electrical source through the power control section. The LED array 314 and heat sink 316 is contained within the cavity of the screw base fixture 312. Overlaying the LED array 314 is an optical diffuser 320 which allows some of the light from the LED light array 314 to pass straight there through while deflecting other portions of the light sideways to provide for good overall illumination of the space lighted by the luminaire 310.

Figure 19:
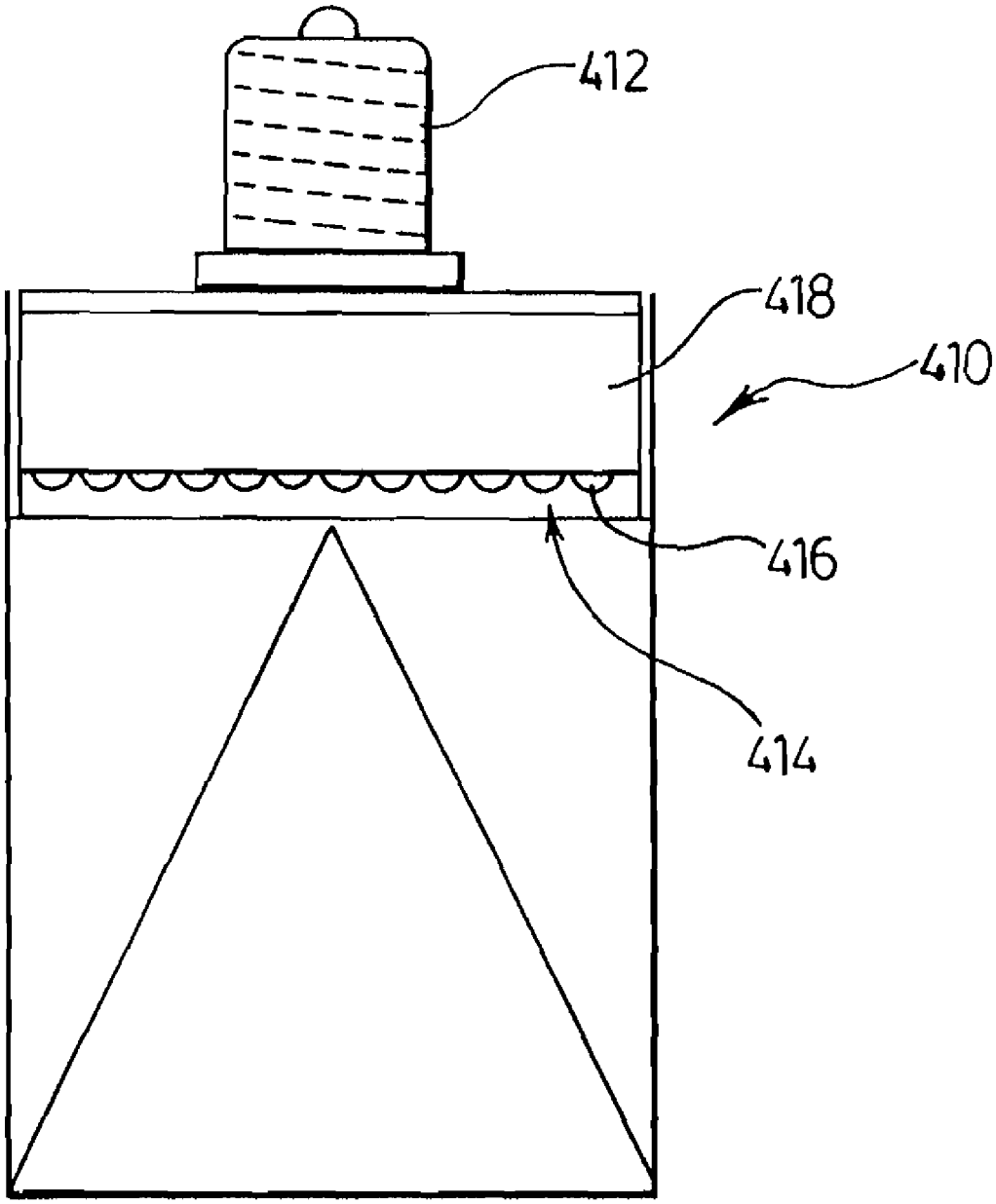
FIG. 19 is a side elevation view in cross section of a variation of a luminaire of FIG. 16.

A variation of this embodiment of a luminaire according to the present invention for use in replacing incandescent light bulbs is illustrated in FIG. 19 generally indicated by the numeral 410. The LED luminaire 410 is provided with a screw-based interface 412 that fits into the standard screw fixtures. The luminaire 410 is provided with a LED light array 414 comprised of a plurality of individual LED's 416 which are attached to a circuit board 418 containing the control circuitry. A ceramic insert 418 is provided to act as a heat sink for the LED array. Overlaying the LED array is a cylindrical wave guide lens housing 420 which allows some of the light from the LED light array to pass straight through while deflecting other portions of the light sideways to provide for good overall illumination of the space lighted by the light fixture 410.

Figure 19C:
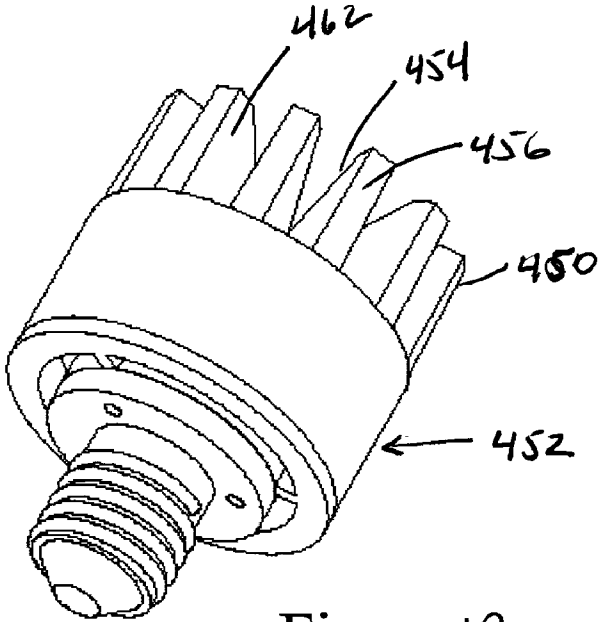
FIGS. 19*a* to 19*c* show various views of a segmented diffuser.
Figure 19B:
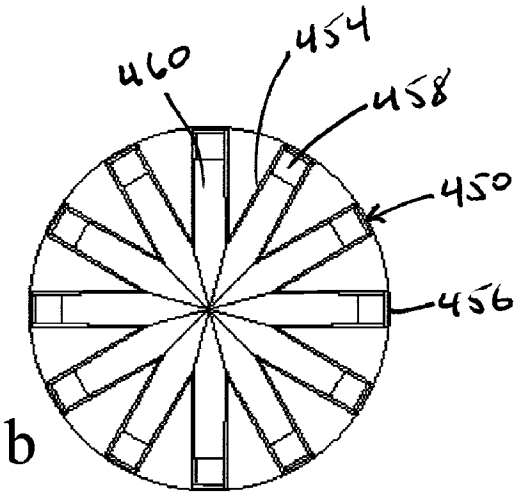
Figure 19A:
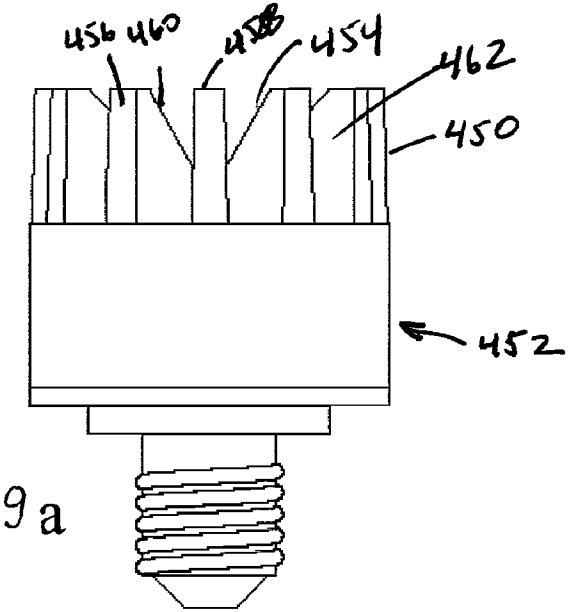
Figure 20:
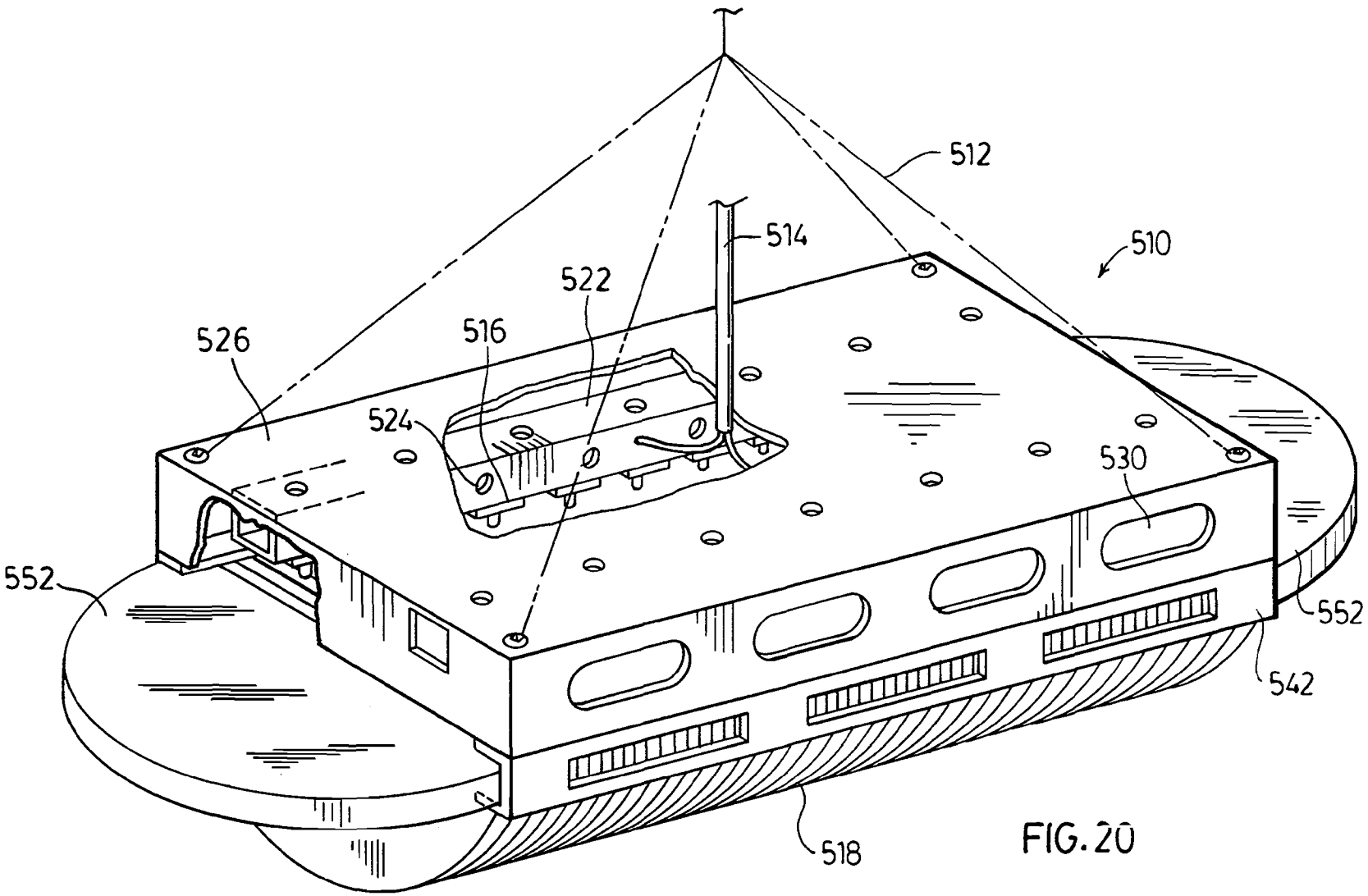
FIG. 20 is a perspective view partly in section of a seventh embodiment of a luminaire of the present invention.

FIGS. 19*a* to 19*c* illustrates a further embodiment of a diffuser 450 for use with an LED luminaire 452 for replacing incandescent bulbs. With this segmented prismatic bulb diffuser, the light source is directed and scattered in many directions. This is accomplished by creating a segmented optic that has multiple gratings that the light can pass through. This segmented prismatic optic utilizes TIR and other principles such as frustration, and multiple images to create isotropic light pattern distributaries. The diffuser 450 comprises a plurality of individual segments 454 symmetrically arranged in a circular pattern. Each of the segments has a generally convex outer surface 456, a flat planar top section 458 generally perpendicular to the outer surface 456 and a sloping inner surface 460 sloping inwardly toward the center of the luminaire 452. The segments have generally vertical planar side surface 462. The angle of the sloping inner surface 460 is selected based upon the nature of the material from which the diffuser is constructed and the characteristics of the light emitted by the LEDs. For example with white LEDs and a diffuser constructed of acrylic, an angle of 42 degrees has been found to provide for the desired TIR.

A seventh embodiment of the LED light fixture of the present invention for use in replacement of fluorescent light fixtures as illustrated in FIGS. 20 to 23 generally indicated by the numeral 510. The LED luminaire 510 illustrated in the figures is adapted to be suspended from a ceiling. A mounting bracket is attached to the ceiling over the electrical outlet box. The luminaire 510 is suspended from the bracket through the use of suitable suspension guy wires 512 and is connected to the electrical box by wire 514. Wire 514 is in turn connected to a power supply, which supplies the power to the LED array assembly 516, the details of which will be described further below. The light from the LED array 516 passes through a diffuser system 518 to provide for even and uniform light output from the luminaire 510.

Figure 21:
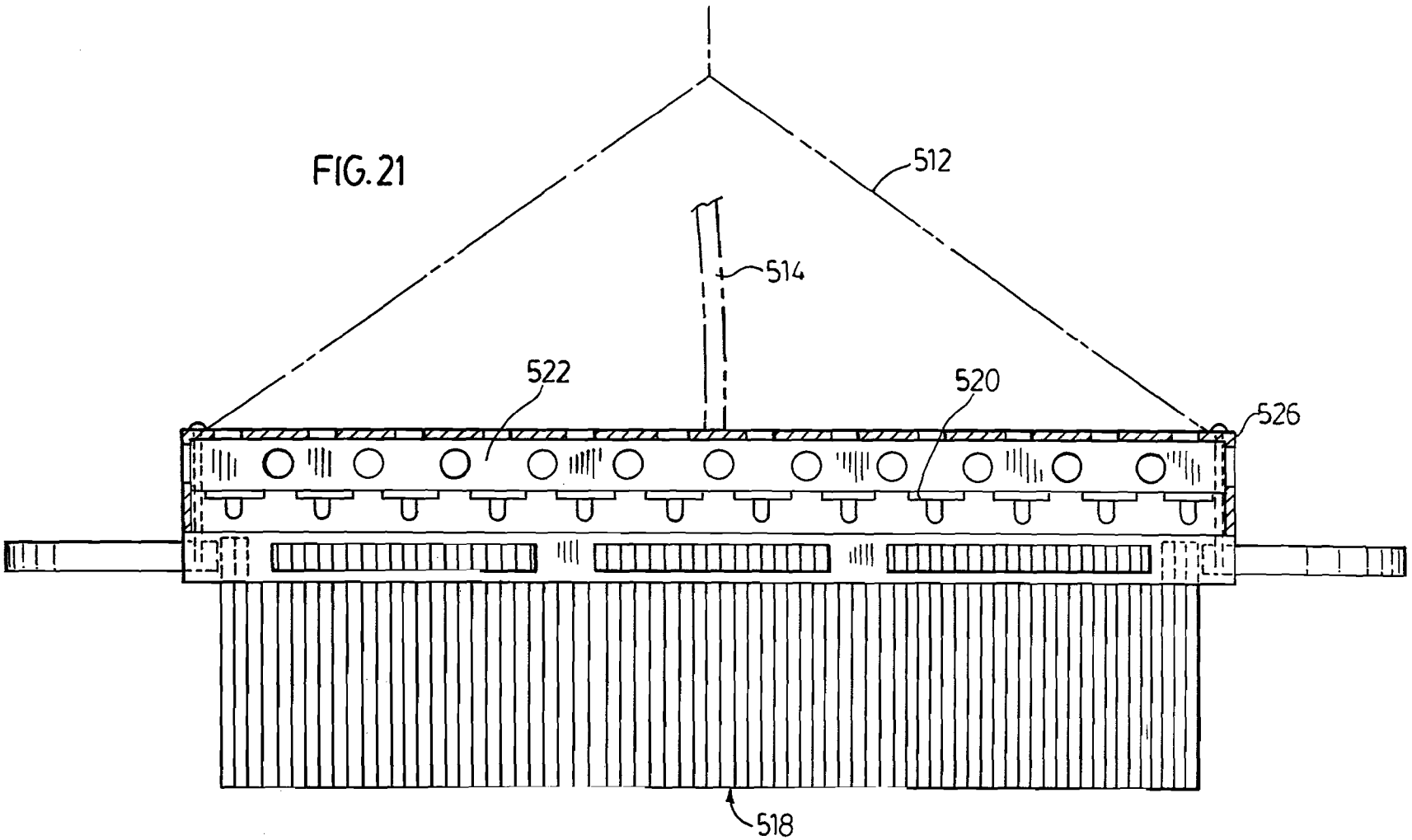
FIG. 21 is a side elevation view in cross section of the luminaire of FIG. 19.
Figure 22:
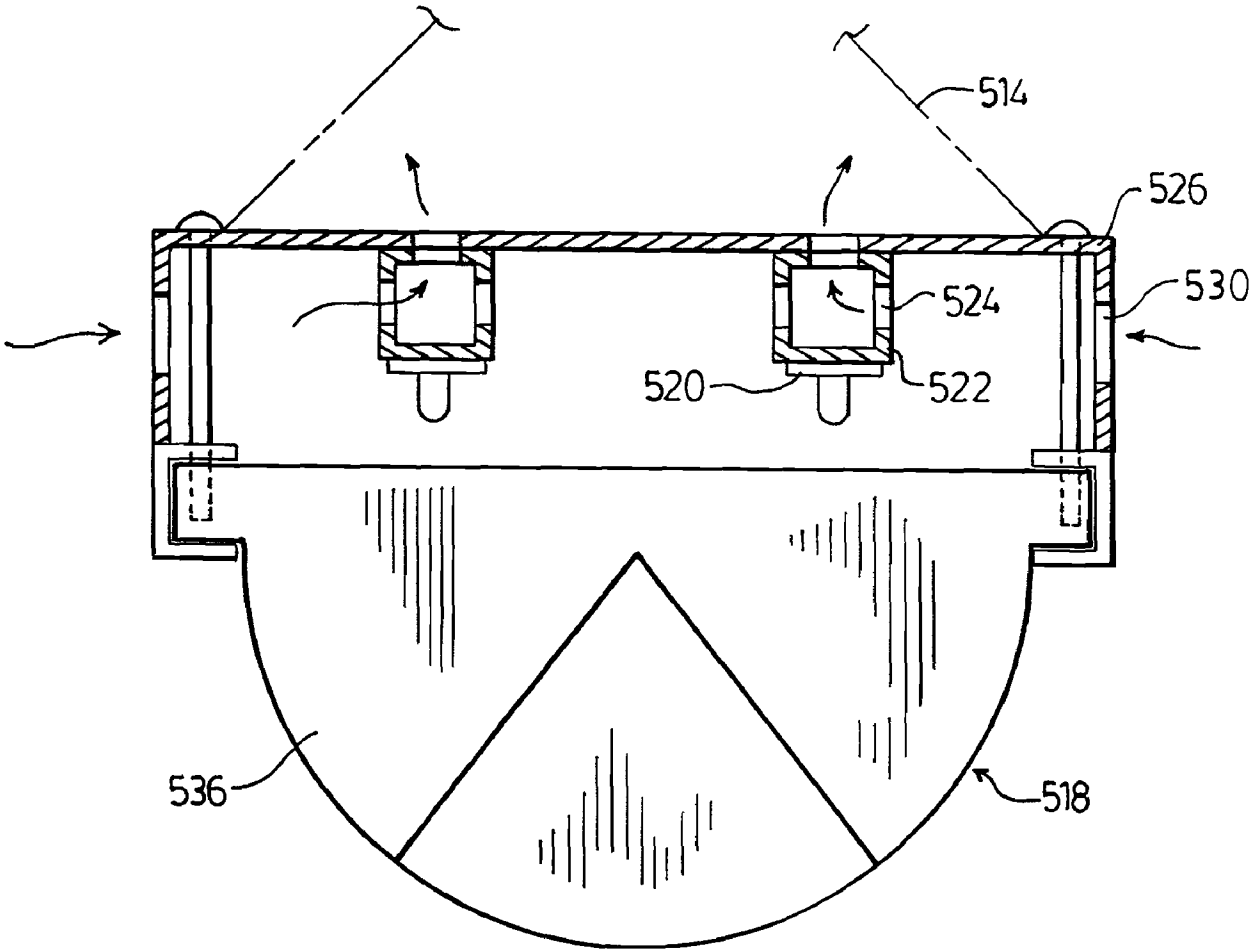
FIG. 22 is an end elevation view in cross section of the luminaire of FIG. 19.
Figure 23:
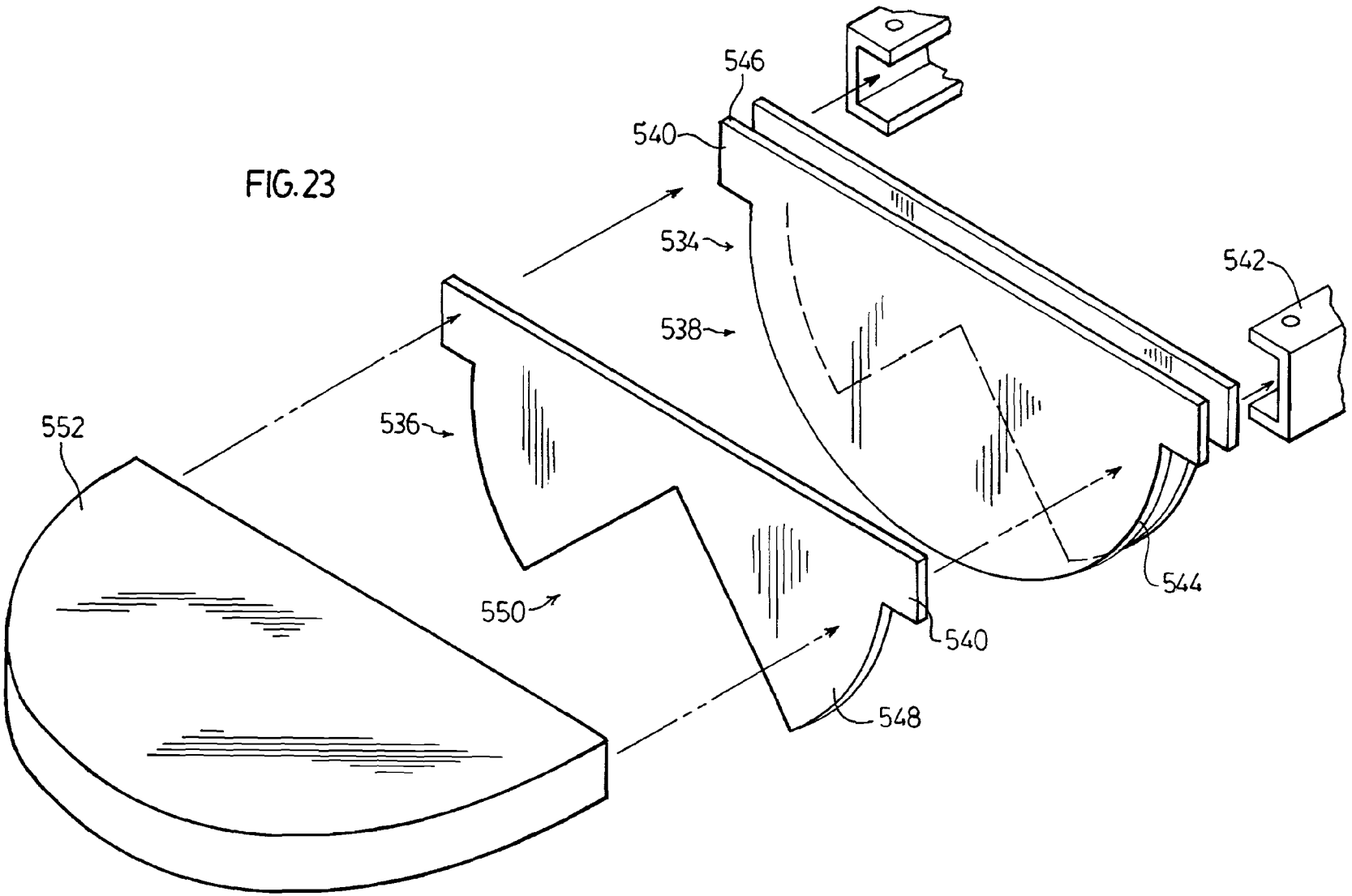
FIG. 23 is an exploded perspective view of the light diffuser of the luminaire of FIG. 19.

The details of the light components of this embodiment are illustrated in detail in FIGS. 21 and 22. The embodiment illustrated utilizes a chip based LED array 520. These chips 520 are provided with about 42 LED's per each chip and the light illustrated in the figures utilizes 14 such chips per side. The LED light array utilizes two parallel rows of LED chips 520 each independently fed by a power supply and controlled by a power controller. The LED chips 520 are mounted on a thermal core heat sink 522, which allows for the heat generated by the LED chips 520 to be dissipated into the atmosphere. The version of the heat sink 522 utilized in the embodiment illustrated is a metal tube 522 to which the LED chips 520 have been attached. The hollow metal tube 522 is provided with openings 524 along the top and sides thereof to allow for airflow through the tube 522 to aid in heat dissipation. The tubes 522 are contained within a casing 526 to which the light diffuser assembly 528 is attached. The casing 526 is provided with a labyrinth arrangement of holes 530 which allow for the proper air flow while minimizing dust infiltration as is illustrated in detail in FIG. 21.

In the fixture 510 illustrated in FIGS. 20 to 23, the light from the LED arrays 520 is directed downwardly into the light diffuser system 518. In the embodiment illustrated, the diffuser system 518 is a composite wave-guide, which provides for diffusion of the light from the LED arrays 520 along the entire surface of the wave-guide. The composite wave-guide is comprised of two types of individual elements 534 and 536 which are alternately stacked together to form the wave guide light diffuser 518.

Element 534 has a generally semicircular shape 538 with wings 540 extending to either side at the top of the element 534. The wings 540 allow the individual elements to be held within U channels 542 which are in turn connected to the casing 526. Element 534 allows for general diffusion of the light from the LED arrays 520 along the exposed surface 544 of the semicircular shape 538. The top surface 546 of element 534 allows for the light from the LED array 520 to enter into the interior of the element 534.

Element 536 is a semicircular shape 548 with a triangular cut-out 550 extending upwardly from the bottom of the semicircular shape 548 and wings 540 extending to either side of the element at the top thereof to be held within the U channels 542. The angles of the triangular cut-out 550 are selected to provide for total internal reflection of the light from the LED array 520 within element 536. The total internal reflection provides for light to be observed at the exposed surfaces of element 536 to provide a light effect.

The elements 534 and 536 are held within the U channel 542 by semicircular end pieces 540 which extend outwardly and are light transparent to provide a further light projection.

Figure 24:
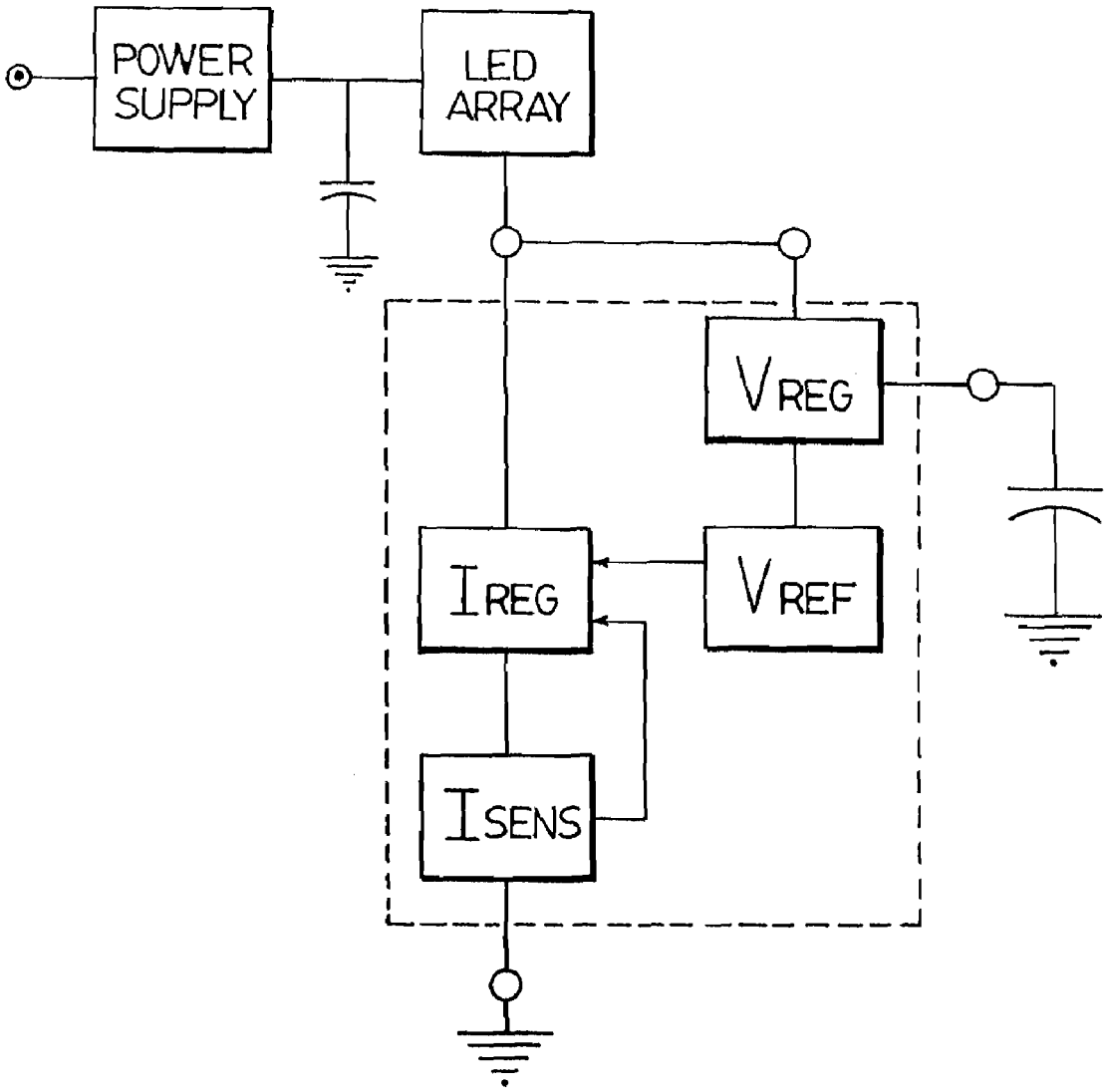
FIG. 24 is a block diagram of a power control circuit of the present invention.

As described above, LED luminaire of the present invention utilizes the LED array as the ballast in the control system. Preferably the control system is an active bootstrap circuit where the dynamic resistance of the LED array is used as the bootstrap. In this way, the LED array in combination with the active bootstrap circuitry controls the power used by the LED array and ensures optimum light output under a wide range of ambient temperatures, as well as maximizing the life of the LED's. A block diagram of the active bootstrap circuitry of the preferred embodiment is illustrated in FIG. 24. Preferably, the LED luminaires of the present invention are connected to the standard residential power such as 120 volts AC as is common in North America although other sources are also useable. A power supply is utilized to convert the 120 volts AC to a DC voltage of the desired level for the size of the LED array utilized in the luminaire. The output of the power supply is fed directly to the LED array which is configured to drop all of the voltage minus the small bootstrap voltage used by the active bootstrap circuitry. Thus for a 168 DC volt linear output and a bootstrap circuit using 5 DC volts, the LED array is designed to use 163 DC volts. In this way, most of the power is used by the LED array.

The LED array is thermally mapped and a dynamic resistance range is obtained. The bootstrap circuitry is connected to LED array and derives the bootstrap voltage from the low side of the LED array. The dynamic resistance of the LED array is used as the bootstrap source by the circuit. The bootstrap circuit has very low internal power requirements and 98% or more of the power is used by the LED array to produce light.

The active bootstrap circuit includes a voltage regulator Vreg to regulate the bootstrap voltage, which is provided to Vref and used to set a reference voltage at a programmed predetermined fixed level to the current regulator Ireg. The predetermined voltage is selected based upon the LED array voltage range and range window size. The predetermined voltage is preferably selected to operate the LED array in the center of its voltage range.

The bootstrap circuit also includes a current regulator to regulate the current flowing in the LED array to provide for the highest efficiency light output from the LED array. The current in the array is sensed by Isens which is programmed to provide a control signal output to the current regulator Ireg. The output of Isens is programmed with reference to the LED array power range and is set to the center of the safe operating range of the array. The bootstrap voltage range is very narrow and only accounts for a very small change in light output, which is not visibly detectable and ensures that 98% or more of the power consumed by the LED array is used to produce light.

The sensed current signal from Isens along with the predetermined reference voltage from Vref are fed to the current regulator Ireg to control the current and hence the power of the LED array. If the sensed current from Isens drifts from the desired value, either as a result of changes in the resistance of the array or from noise in the supply voltage, Ireg actively adjusts the current flowing in the array to compensate and return the sensed value to the desired level. The response time for the adjustment is instantaneous, thus the power controller can immediately offset any fluctuations in the power levels of the LED array. This results in further power efficiencies and flicker free light output, as noise generated in the power supply or array are immediately cancelled out. By utilizing these feedback loops of sensed current and reference voltage, changes in the, dynamic resistance of the LED array are actively detected, adjusted, and optimized for the highest power efficiency and light output. Thus the circuitry of the present invention overcomes the prior art problem where an LED array may run away, as the electrical characteristics of the LED change with increased temperature either from increased ambient temperature or heat generated by the LED array.

The present invention provides for LED luminaires, which can produce a light of a suitable intensity and color for a task for which the fixture is to be used. For example, an LED luminaire in accordance with the third embodiment with selection of the proper LED will produce the equivalent lighting as that of a 40 watt fluorescent light fixture while utilizing significantly less power while providing for extending life between replacement as the life expectancy of an LED is 20 plus years in continuous use. The luminaires of the sixth embodiment can be utilized for replacement of typical incandescent bulbs especially in indicator systems such as is used in subways to indicate that a section of the subway is powered as well as for block control to control the movement of the trains along the track, thus for indicating whether a section of the track is powered, the indicator bulb is generally blue while for the train control lighting typical red, amber and green lights are utilized by selection of the proper LED's these indicator lights are easily replaced. With the design of the sixth embodiment, it has been found that LED's drawing 5 watts will produce a similar light output as a 60 watt light bulb while achieving 90% electrical saving as well as significantly reduce maintenance costs as bulbs do not have to be replaced as frequently as typical incandescent bulbs. The light of this embodiment may also be utilized with a resetable fuse such that if some of the LED were to burn out, the fuse opens and then closes after a few seconds. Thus a flashing bulb indicates defective LED's and that the bulb needs to be replaced.

Figure 25:
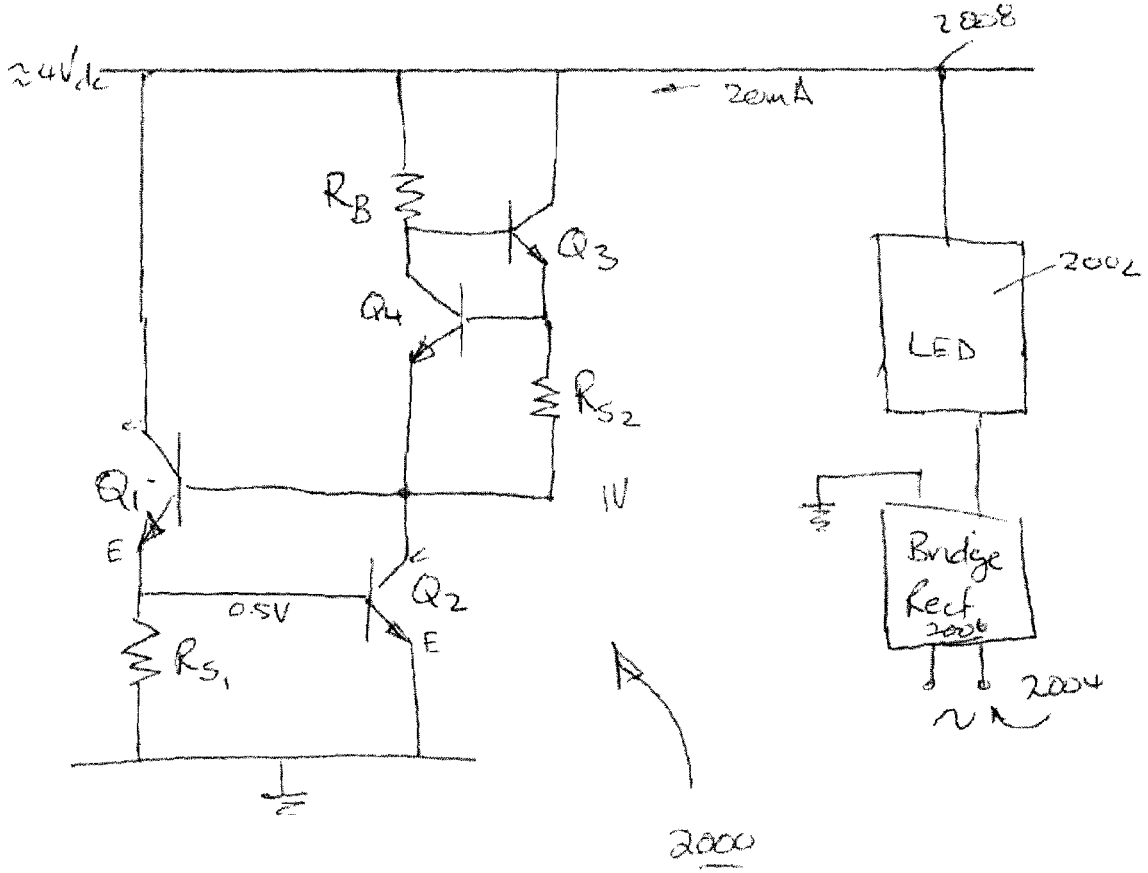
FIG. 25 is a circuit diagram of a preferred embodiment of the power control circuit of the present invention.

Referring to FIG. 25 there is shown a circuit diagram of a power control circuit 2000 for controlling a LED array 2002 powered from an AC voltage source 2004 according to an embodiment of the present invention. The AC power source, typically 115 Vrms (170V peak) in North America is applied to a bridge rectifier 2006, the output of which is filtered to produce approximately 170 VDC supply voltage to the LED array and power controller circuit 2000. The LED array 2002 has a predetermined number of LED's connected in one or more groups of connected LED's so as to produce at most a voltage drop across the power control circuit 2000 which is as low as possible so that most of the power is used by the LED array 2002 to generate light. The voltage drop across the power control circuit 2000 is the amount necessary or sufficient to power the active components of the power control circuit 2000. Generally, this amount will be approximately equivalent to a single LED forward voltage, typically 4 VDC. The groups of LED's in the array include at least one group of LED's connected in series to produce the requisite voltage drop across the power control circuit.

The circuit 2000 functions as a current regulator to the LED array which acts as a variable load resistance. The circuit 2000 senses any changes in current through the array due to for example increase in temperature or changes in supply voltage.

The circuit 2000 includes an NPN transistor Q1 having its emitter collector circuit connected between the 4 VDC nodes 2008 and ground via a resistor Rs1. The emitter resistor Rs1 provides negative feedback along with a voltage divider to provide a nearly constant VB. to Q1. The voltage divider for Q1 is provided by Q2, Q3 and Q4. The transistor Q2 has its base connected to the emitter of Q1 and its collector emitter terminals connected between the base of Q1 and ground to form a lower portion of the voltage divider. The upper portion of the voltage divider is formed by a similar configuration-using transistor Q3 and Q4. The current to the base of the transistor Q1 is supplied by the voltage divider. The equivalent resistance of the voltage divider is low, so the variation in base current to Q1 does not cause the base voltage to change very much. This improves the negative feed back effect of the emitter resistor Rs1.

The value for Rs1=33.3 ohms and is calculated by assuming the Vbe drop across Q2 to be 0.5 V and a current through the resistor to be 15 mA (which is the forward current through the LED's). Similarly the resistance value of Rs2 which is coupled to the emitter of Q3 and the base of Q1 is 100 ohms (assuming a current of 5 mA through the resistor) transistor Q2.

The value for the resistor Rb is 2 kU which is calculated by assuming a current of 1 mA and a voltage drop of 2V (Q2 and Q4 have their CE circuits connected in series and each have nominal voltage drop of 1V)

The number of LEDs for the array is chosen as follows: Assuming a supply voltage of approximately 170 VDC and a forward voltage drop across each diode of 3.6 VDC at 25 deg. Celsius. For a controller voltage of approximately 4 VDC, the voltage drop across the LED array is 170 VDC −4 VDC that is approximately equivalent to 46 LED's (165 VDC). Therefore 46 LEDs are used in the array 2002.

In a preferred embodiment transistors Q1-Q4 are TO-92 type NPN transistors with a hfe=100.

As is known a fairly direct relationship exists between the forward drive current versus the relative output luminosity for a light emitting diode. The luminous intensity is normally at its maximum at the rated DC forward drive current operating at an ambient temperature of 25 degrees Celsius. When the drive current is less than the rated forward drive current, the output will be correspondingly lower. The described circuit arrangements, therefore, will cause the light emitting diodes to give out a lower light output when the input alternating current voltage is lowered. This makes the light emitting diodes and the related circuitry ideal replacements for existing incandescent filament lamps, because they can be operated with and be dimmed using conventional SCR type wall dimmers.

In summary, typical prior art configurations mostly consist of LED's connected in parallel branches with limiting resistors to overcome current hogging in the branches, but at the cost of wasted input power. This wasted power increases with an increase in array size which in turn, raises circuit operating temperature, shortens LED life, and reduces the light output. Branch currents add up as the array size is increased and as a result, require large, high current power supplies, and as a result, limit practical luminaire design.

Typical controllers, sample only one branch current, and are thus blind to the majority of the branch currents since only one branch is sampled, thus allowing, branch hogging which results in uneven brightness and temperature variations across the array. Also, with the high power demands on the controller, input power is additionally wasted, which raises operating temperature and reduces reliability.

While the prior art approach may be fine for low power applications, at higher power levels, the low efficiency of this design becomes an engineering obstacle for practical high power luminaire designs.

The present invention, not only resolves these inefficiencies, but also, facilitates the design of very high power LED array's that can be fully integrated into very compact luminaire designs. The present invention eliminates the wasted input power associated with typical line power LED arrays by replacing the step down circuitry in the power supply with the LED array and a low power controller. By utilizing the voltage drops across the LED's, the output voltage of the rectified mains is stepped down, in discrete voltage steps to a level sufficient to power the active components of the power control circuit, generally equal to that of a single LED. The advantage is that the input power that would have been used to step down the voltage in a typical power supply, is now used to produce light, thus resulting in better power efficiency, and a decrease in power supply size.

Another advantage this invention offers is the elimination of limiting resistors and the wasted input power incurred from their use. Since the LED's in this invention are all in series and the current through them is the same, the problems with even distribution of the array's brightness and temperature of the prior art are eliminated.

Additionally, since the circuit current, in this invention, is common to all of the LED's in the array, the controller is not blind to any of the LED's in the array and eliminates current hogging. Also, since the controller is in series with the array, controller power is considerably reduced.

Since input voltage to the controller in this invention is supplied by the LED array, any voltage variations caused by changes in the dynamic resistance of the LED's will also present at the controller input. In this invention, these voltage variations are extracted and utilized as a feedback signal for power control. The advantage over the prior art is that, the wire used to power the controller is the same wire that carries the power control feedback signal. This eliminates the need for separate feedback signal paths and further reduces circuit complexity.

Although various preferred embodiments of the present invention have been described in detail, it would be appreciated by those skilled in the art that variations may be made thereto without departing from the spirit of the invention.

The embodiments of the invention in which an exclusive property or privilege is claimed are defined as follows:

1. A lighting source comprising:

a housing adapted for coupling to an AC power source;

a rectifier circuit for converting said AC power to a DC supply;

a power control circuit disposed in said housing;

a string of LED's, the LEDs in the string being connected in series between the DC supply and the power control circuit and being of a number selected to produce a voltage difference across said power control circuit at the low voltage side of the string of LED's sufficient to power active components of said power control circuit when powered from said DC supply and said power control circuit for limiting a forward current through said string to a nominal forward current of a single LED.

2. A lighting source as defined in claim 1, said power control circuit comprising a first transistor having its collector emitter terminals coupled via a current limiting resistor between said control node and ground and a voltage divider circuit coupled between said control node and ground for providing a constant base voltage bias to said transistor.

3. A lighting source as defined in claim 2, said voltage divider comprising a second transistor coupled between the base terminal of said first transistor and ground for determining said base voltage of said first transistor.

4. A lighting source as defined in claim 3, said voltage divider circuit comprising a third transistor having its collector emitter terminals coupled via a base current limiting resistor between said control node and the base terminal of said first transistor.

5. A lighting source as defined in claim 4, said transistors being bipolar junction transistors.

6. A high voltage LED light source comprising:

an LED array including a series coupled string of LED's;

a means for coupling to an AC supply;

an AC to DC converter for converting said AC supply to a DC supply;

a power control section for controlling power in the LED array, said series coupled string of LED's electrically connected between a control node of said power control section and said DC power supply, the LEDs in the string being of a number selected to produce a voltage difference across said power control circuit sufficient to power active components of said power control circuit when powered from said DC supply and said power control circuit for limiting a forward current through said string to a nominal forward current of a single LED such that the power control section utilizes the dynamic resistance of the LED array as an active component of the control section.

7. A high voltage LED light source according to claim 6 wherein the power control section comprising an active bootstrap circuit connected to a low voltage side of the LED array, the active bootstrap circuit comprising a means for sensing current in the LED array and providing the sensed current which varies as a function of the dynamic resistance of the LED array, to a current regulator means to adjust the current in the LED array to maintain the current at the desired level.

8. A high voltage LED light source according to claim 7 wherein the active bootstrap circuit includes a means for providing a predetermined fixed reference voltage to the current regulator means.

9. A high voltage LED light source according to claim 6 wherein the AC to DC converter comprises a linear non-switching power supply to supply DC directly to a high voltage side of the LED array.

10. A high voltage LED light source according to claim 6 wherein the power control section comprising a first transistor having its collector emitter terminals coupled via a current limiting resistor between said control node and ground and a voltage divider circuit coupled between said control node and ground for providing a constant base voltage bias to said transistor.

11. A high voltage LED light source according to claim 10, said voltage divider comprising a second transistor coupled between the base terminal of said first transistor and ground for determining said base voltage of said first transistor.

12. A high voltage LED light source according to claim 11, said voltage divider circuit comprising a third transistor having its collector emitter terminals coupled via a base current limiting resistor between said control node and the base terminal of said first transistor.

13. A high voltage LED light source according to claim 12, said transistors being bipolar junction transistors.

14. A high voltage LED light source comprising:

an LED array including a series coupled string of LED's;

a means for coupling to an AC supply;

an AC to DC converter for converting the AC supply to a DC supply;

a power control section for controlling power in the LED array, said series coupled string of LED's being electrically connected between a control node of said power control section and said DC power supply, the LEDs in the string being of a number selected to produce a voltage difference across said power control circuit equivalent to a voltage difference across a single LED in said string of LED's, said power control circuit utilizing the dynamic resistance of the LED array as an active component of the control section.

15. A high voltage LED light source according to claim 14 wherein the power control section comprising an active bootstrap circuit connected to a low voltage side of the LED array, the active bootstrap circuit comprising a means for sensing current in the LED array and providing the sensed current, which varies as a function of the dynamic resistance of the LED array, to a current regulator means to adjust the current in the LED array to maintain the current at the desired level.

16. A high voltage LED light source according to claim 15 wherein the active bootstrap circuit includes a means for providing a predetermined fixed reference voltage to the current regulator means.

17. A high voltage LED light source according to claim 16 wherein the AC to DC converter comprises a linear non-switching power supply to supply DC directly to a high voltage side of the LED array.

18. A high voltage LED light source according to claim 17 wherein the power control section comprising a first transistor having its collector emitter terminals coupled via a current limiting resistor between said control node and ground and a voltage divider circuit coupled between said control node and ground for providing a constant base voltage bias to said transistor.

19. A high voltage LED light source according to claim 18, said voltage divider comprising a second transistor coupled between the base terminal of said first transistor and ground for determining said base voltage of said first transistor.

20. A high voltage LED light source according to claim 19, said voltage divider circuit comprising a third transistor having its collector emitter terminals coupled via a base current limiting resistor between said control node and the base terminal of said first transistor.

21. A high voltage LED light source according to claim 20, said transistors being bipolar junction transistors.

* * * * *